US010964254B2

(12) United States Patent
Hung et al.

(10) Patent No.: US 10,964,254 B2
(45) Date of Patent: Mar. 30, 2021

(54) PIXEL CIRCUIT FOR ADJUSTING PULSE WIDTH OF DRIVING CURRENT AND DISPLAY PANEL HAVING THE SAME

(71) Applicant: AU Optronics Corporation, Hsin-Chu (TW)

(72) Inventors: Chia-Che Hung, Hsin-Chu (TW); Ting-Wei Guo, Hsin-Chu (TW); Mao-Hsun Cheng, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/579,922

(22) Filed: Sep. 24, 2019

(65) Prior Publication Data

US 2020/0357332 A1 Nov. 12, 2020

(30) Foreign Application Priority Data

May 8, 2019 (TW) ..... 108115942

(51) Int. Cl.
*G09G 3/32* (2016.01)

(52) U.S. Cl.
CPC ..... *G09G 3/32* (2013.01); *G09G 2320/0242* (2013.01); *G09G 2320/064* (2013.01); *G09G 2320/0633* (2013.01)

(58) Field of Classification Search
CPC combination set(s) only.
See application file for complete search history.

(56) References Cited

U.S. PATENT DOCUMENTS

| | | | | |
|---|---|---|---|---|
| 8,446,343 | B2 | 5/2013 | Akimoto et al. | |
| 2013/0082906 | A1 | 4/2013 | Toyomura et al. | |
| 2016/0351130 | A1 | 12/2016 | Kikuchi et al. | |
| 2018/0293929 | A1 | 10/2018 | Shigeta et al. | |
| 2019/0306945 | A1* | 10/2019 | Valentine | G09G 3/32 |
| 2019/0371231 | A1* | 12/2019 | Kim | G09G 3/2011 |

FOREIGN PATENT DOCUMENTS

| | | |
|---|---|---|
| CN | 109584801 | 4/2019 |

* cited by examiner

*Primary Examiner* — Lixi C Simpson
(74) *Attorney, Agent, or Firm* — WPAT, PC

(57) ABSTRACT

The disclosure provides a pixel circuit including a lighting element, a current source, an amplitude control circuit, a pulse width control circuit, and an internal compensation circuit. The current source includes a driving transistor, and provides a driving current to the lighting element by the driving transistor. The amplitude control circuit includes a first switch, and provides a first voltage to the driving transistor by the first switch to determine magnitude of the driving current. The pulse width control circuit provides a second voltage to the first switch to determine a pulse width of the driving current. The internal compensation circuit is coupled with the current source and the amplitude control circuit, detects a threshold voltage of the first switch, and provides the driving current to an external compensation circuit to render the external compensation circuit detect a threshold voltage of the driving transistor.

20 Claims, 21 Drawing Sheets

PIXEL CIRCUIT FOR ADJUSTING PULSE WIDTH OF DRIVING CURRENT AND DISPLAY PANEL HAVING THE SAME

CROSS-REFERENCE TO RELATED APPLICATION

This application claims priority to Taiwan Application Serial Number 108115942, filed May 8, 2019, which is herein incorporated by reference in its entirety.

BACKGROUND

Field of Invention

The present disclosure generally relates to a pixel circuit and a display panel. More particularly, the present disclosure relates to a pixel circuit including a pulse width control circuit and an amplitude control circuit.

Description of Related Art

Comparing with liquid crystal displays (LCD), micro LED displays have advantages including low power consumption, high color saturation, high response speed, etc. As a result, the micro LED displays is considered as one of the popular choices for next-generation displays. The brightness of a micro LED is determined by a driving current flow through the micro LED, but the emission color of the micro LED shifts with the variation of the driving current. In addition, micro LEDs corresponding to different emission colors have points of maximum luminous efficiency corresponding to different driving currents.

SUMMARY

The disclosure provides a pixel circuit including a lighting element, a current source, an amplitude control circuit, a pulse width control circuit, and an internal compensation circuit. The lighting element is configured to emit according to a driving current. The current source includes a driving transistor, and is configured to provide the driving current to the lighting element by the driving transistor. The driving transistor includes a first terminal, a second terminal, and a control terminal, and the second terminal of the driving transistor is coupled with the lighting element. The amplitude control circuit includes a first switch and a first node configured to provide a first voltage. The amplitude control circuit is configured to provide the first voltage to the control terminal of the driving transistor by the first switch to determine magnitude of the driving current. The pulse width control circuit includes a second node configured to provide a second voltage. The pulse width control circuit is configured to provide the second voltage to a control terminal of the first switch to determine a pulse width of the driving current. The internal compensation circuit is coupled with the current source and the amplitude control circuit, is configured to detect a threshold voltage of the first switch, and is configured to provide the driving current to an external compensation circuit to render the external compensation circuit detect a threshold voltage of the driving transistor.

The disclosure provides a display panel including multiple pixel circuits, a source driver, and a gate driver. The multiple pixel circuits are arranged as a pixel array. Each of the multiple pixel circuits includes a first switch and a driving transistor. The first switch includes a first terminal, a second terminal, and a control terminal. The driving transistor includes a first terminal, a second terminal, and a control terminal. The first terminal of the first switch is coupled with the control terminal of the driving transistor. The second terminal of the first switch is coupled with a first node. The control terminal of the first switch is coupled with a second node. The source driver is configured to provide a first data signal, a second data signal, and a linear varying voltage to the plurality of pixel circuits. The gate driver is configured to drive multiple rows of the pixel array to receive the first data signal sequentially to set a first voltage of the first node of each of the multiple pixel circuits, and is configured to drive the multiple rows of the pixel array to receive the second data signal sequentially to set a second voltage of the second node of each of the multiple pixel circuits. The source driver uses the linear varying voltage to control the second voltage of each of the multiple pixel circuits synchronously. The external compensation circuit is configured to detect a threshold voltage of the driving transistor of each of the multiple pixel circuits, and is configured to adjust the first data signal provided to a corresponding pixel circuit according to the threshold voltage of the driving transistor of each of the multiple pixel circuits. Each of the multiple pixel circuits further includes a lighting element, a current source, an amplitude control circuit, a pulse width control circuit, and an internal compensation circuit. The lighting element is configured to emit according to a driving current. The current source includes the driving transistor, and is configured to provide the driving current to the lighting element by the driving transistor. The second terminal of the driving transistor is coupled with the lighting element. The amplitude control circuit includes the first switch and the first node, and is configured to provide the first voltage to the control terminal of the driving transistor by the first switch to determine magnitude of the driving current. The pulse width control circuit includes the second node, and is configured to provide the second voltage to the control terminal of the first switch to determine a pulse width of the driving current. The internal compensation circuit is coupled with the current source and the amplitude control circuit, is configured to detect a threshold voltage of the first switch, and is configured to provide the driving current to the external compensation circuit to render the external compensation circuit detect the threshold voltage of the driving transistor.

It is to be understood that both the foregoing general description and the following detailed description are by examples, and are intended to provide further explanation of the disclosure as claimed.

DETAILED DESCRIPTION

Figure 1:
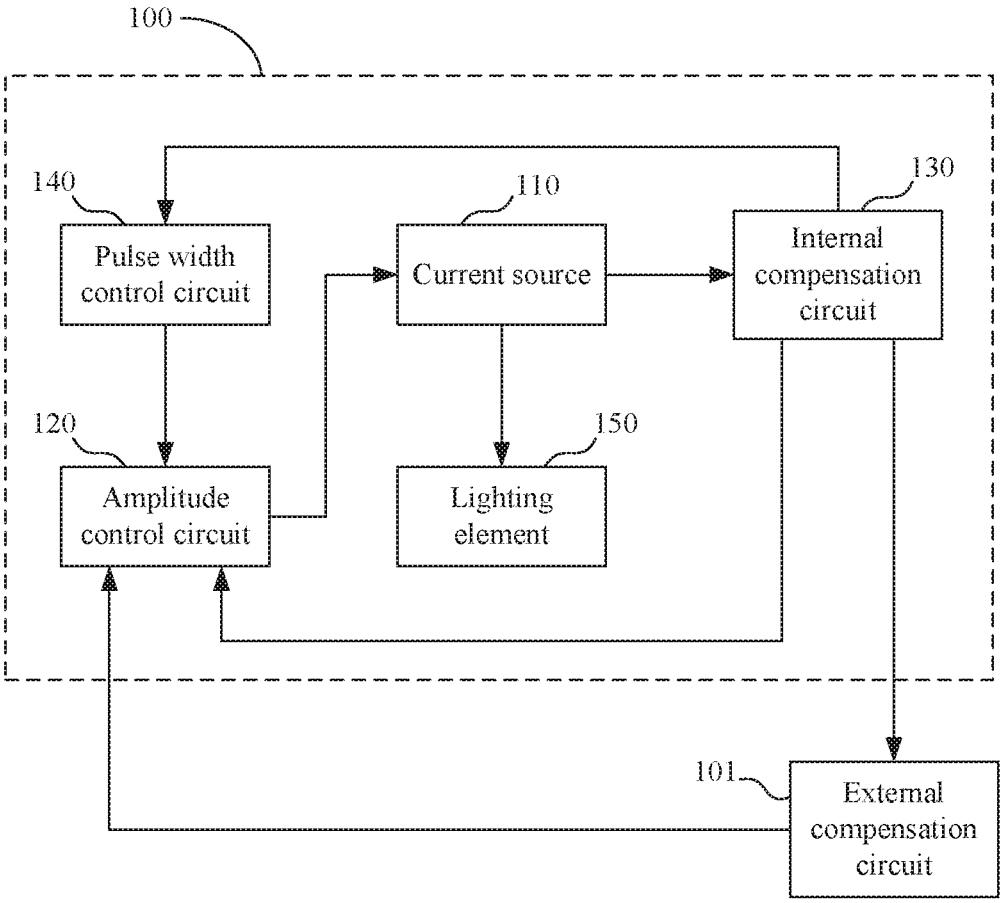
FIG. 1 is a simplified functional block diagram of a pixel circuit according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a simplified functional block diagram of a pixel circuit 100 according to one embodiment of the present disclosure. The pixel circuit 100 comprises a current source 110, an amplitude control circuit 120, an internal compensation circuit 130, a pulse width control circuit 140, and a lighting element 150. The current source 110 is configured to provide a driving current to the lighting element 150, so that the lighting element 150 has brightness corresponding to magnitude of the driving current. The amplitude control circuit 120 is configured to enable the current source 110, and configured to determine magnitude of the driving current. The pulse width control circuit 140 is configured to determine a time length for the amplitude control circuit 120 to enable the current source 110, so as to determine a pulse width of the driving current provided by the current source 110.

The internal compensation circuit 130 is configured to detect characteristic variations of element(s) of the amplitude control circuit 120, and configured to transmit the detection result to the pulse width control circuit 140. The pulse width control circuit 140 may adaptively control the amplitude control circuit 120 according to the detection result, so that the pulse width of the driving current is immune to the element characteristic variations of the amplitude control circuit 120.

In addition, the internal compensation circuit 130 is further configured to provide the driving current to an external compensation circuit 101, and the external compensation circuit 101 may detect the characteristic variations of element(s) of the current source 110. The external compensation circuit 101 may adaptively control the amplitude control circuit 120 according to the element characteristic variations of the current source 110, so that the magnitude of the driving current is immune to the element characteristic variations of the current source 110.

Figure 2:
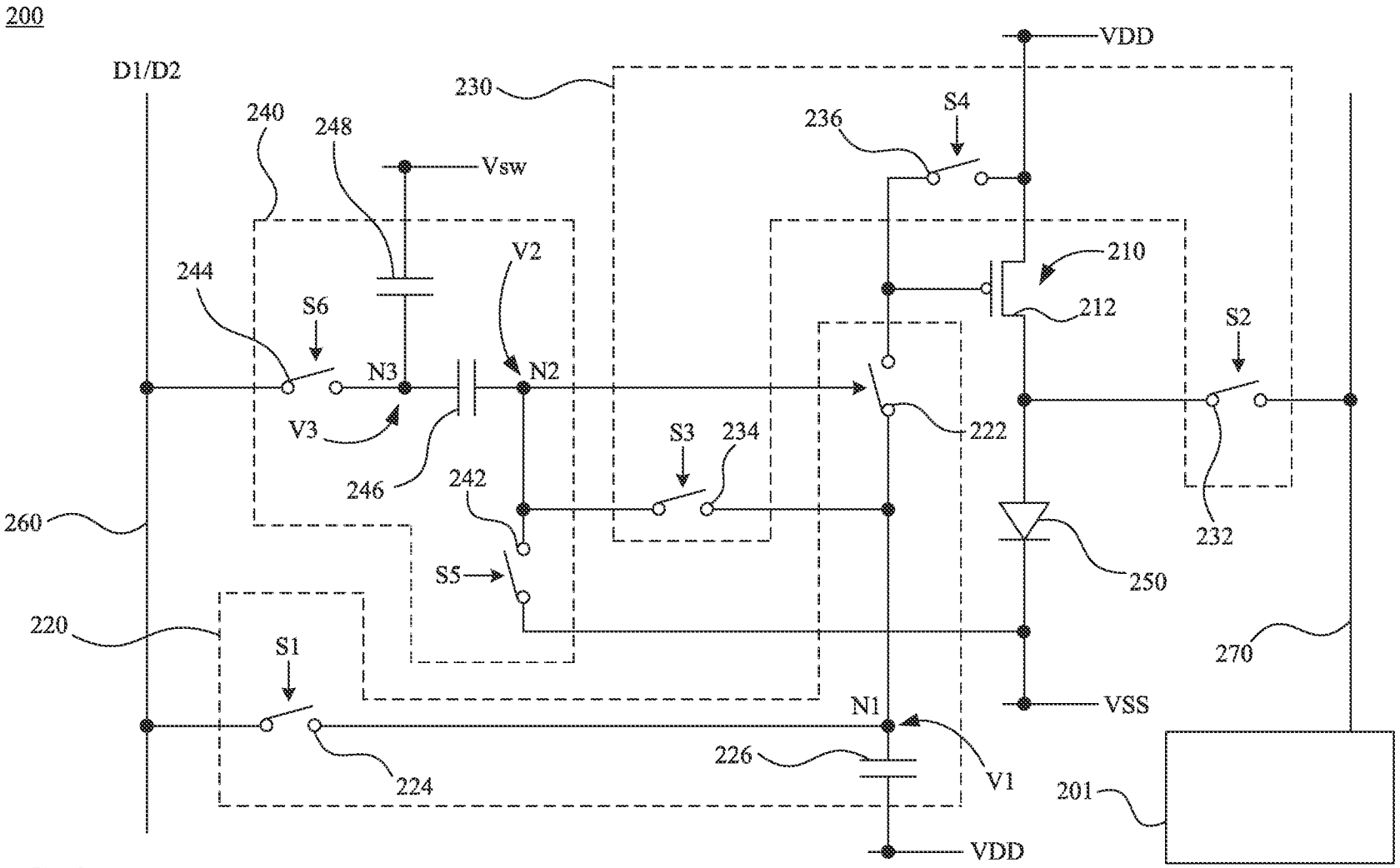
FIG. 2 is a functional block diagram of a pixel circuit according to one embodiment of the present disclosure.

FIG. 2 is a functional block diagram of a pixel circuit 200 according to one embodiment of the present disclosure. The pixel circuit 200 comprises a current source 210, an amplitude control circuit 220, an internal compensation circuit 230, a pulse width control circuit 240, and a lighting element 250. The current source 210 and the lighting element 250 of FIG. 2 may be the current source 110 and the lighting element 150 of FIG. 1, respectively, and the current source 210 comprises a driving transistor 212 configured to generate the driving current. A first terminal of the driving transistor 212 is configured to receive a system high voltage VDD. A second terminal of the driving transistor 212 is coupled with a first terminal (e.g., the anode) of the lighting element 250. A second terminal (e.g., the cathode) of the lighting element 250 is configured to receive a system low voltage VSS.

The amplitude control circuit 220 of FIG. 2 may be the amplitude control circuit 120 of FIG. 1, and comprises a first switch 222, a second switch 224, a first capacitor 226, and a first node N1 configured to provide a first voltage V1. A first terminal of the first switch 222 is coupled with a control terminal of the driving transistor 212. The second terminal of the first switch 222 is coupled with the first node N1. The control terminal of the first switch 222 is coupled with the pulse width control circuit 240. Therefore, the amplitude control circuit 220 may provide the first voltage V1 to the control terminal of the driving transistor 212 by the first switch 222, so as to determine the magnitude of the driving current. A first terminal of the second switch 224 is configured to receive a first data signal D1 from a data line 260. A second terminal of the second switch 224 is coupled with the first node N1. A control terminal of the second switch 224 is configured to receive a first control signal S1. A first terminal of the first capacitor 226 is coupled with the first node N1. A second terminal of the first capacitor 226 is configured to receive the system high voltage VDD.

The internal compensation circuit 230 of FIG. 2 may be the internal compensation circuit 130 of FIG. 1, and comprises a third switch 232, a fourth switch 234, and a fifth switch 236. A first terminal of the third switch 232 is coupled with the second terminal of the driving transistor 212. A second terminal of the third switch 232 is coupled with the external compensation circuit 201 through the transmission line 270. A control terminal of the third switch 232 is configured to receive a second control signal S2. A first terminal of the fourth switch 234 is coupled with the pulse width control circuit 240. A second terminal of the fourth switch 234 is coupled with the first node N1. A control terminal of the fourth switch 234 is configured to receive a third control signal S3. A first terminal of the fifth switch 236 is coupled with the control terminal of the driving transistor 212. A second terminal of the fifth switch 236 is coupled with the first terminal of the driving transistor 212. A control terminal of the fifth switch 236 is configured to receive a fourth control signal S4.

The pulse width control circuit 240 of FIG. 2 may be the pulse width control circuit 140 of FIG. 1, and comprises a sixth switch 242, a seventh switch 244, a second capacitor 246, a third capacitor 248, a second node N2 configured to provide a second voltage V2, and a third node N3 configured to provide a third voltage V3. A first terminal of the sixth switch 242 is coupled with the second node N2. A second terminal of the sixth switch 242 is coupled with the second terminal of the lighting element 250. A control terminal of the sixth switch 242 is configured to receive a fifth control signal S5. A first terminal of the seventh switch 244 is configured to receive a second data signal D2 from the data line 260. A second terminal of the seventh switch 244 is coupled with the third node N3. A control terminal of the seventh switch 244 is configured to receive a sixth control signal S6. The second capacitor 246 is coupled between the second node N2 and the third node N3. A first terminal of the third capacitor 248 is configured to receive a linear varying voltage $V_{SW}$. A second terminal of the third capacitor 248 is coupled with the third node N3. In addition, the second node N2 is coupled with the control terminal of the first switch 222 and the first terminal of the fourth switch 234.

The external compensation circuit 201 of FIG. 2 may be the external compensation circuit 101 of FIG. 1, and is configured to receive the driving current from the internal compensation circuit 230 to detect a threshold voltage of the driving transistor 212. The external compensation circuit 201 may adaptively adjust the first data signal D1 based on the threshold voltage of the driving transistor 212. In practice, the external compensation circuit 201 may be realized by the application specific integrated circuit (ASIC), and also may be realized by other hardware component capable of executing commands (e.g., the field programmable gate array (FPGA), the central processing unit (CPU), or the microprocessor).

In addition, the plurality of switches and the driving transistor 212 of FIG. 2 may be realized by P-type transistors of any suitable category, such as P-type thin-film transistors (TFT), P-type MOSFETs, etc. The lighting element 250 may be realized by the Micro LED or the organic light-emitting diode (OLED).

Figure 3:
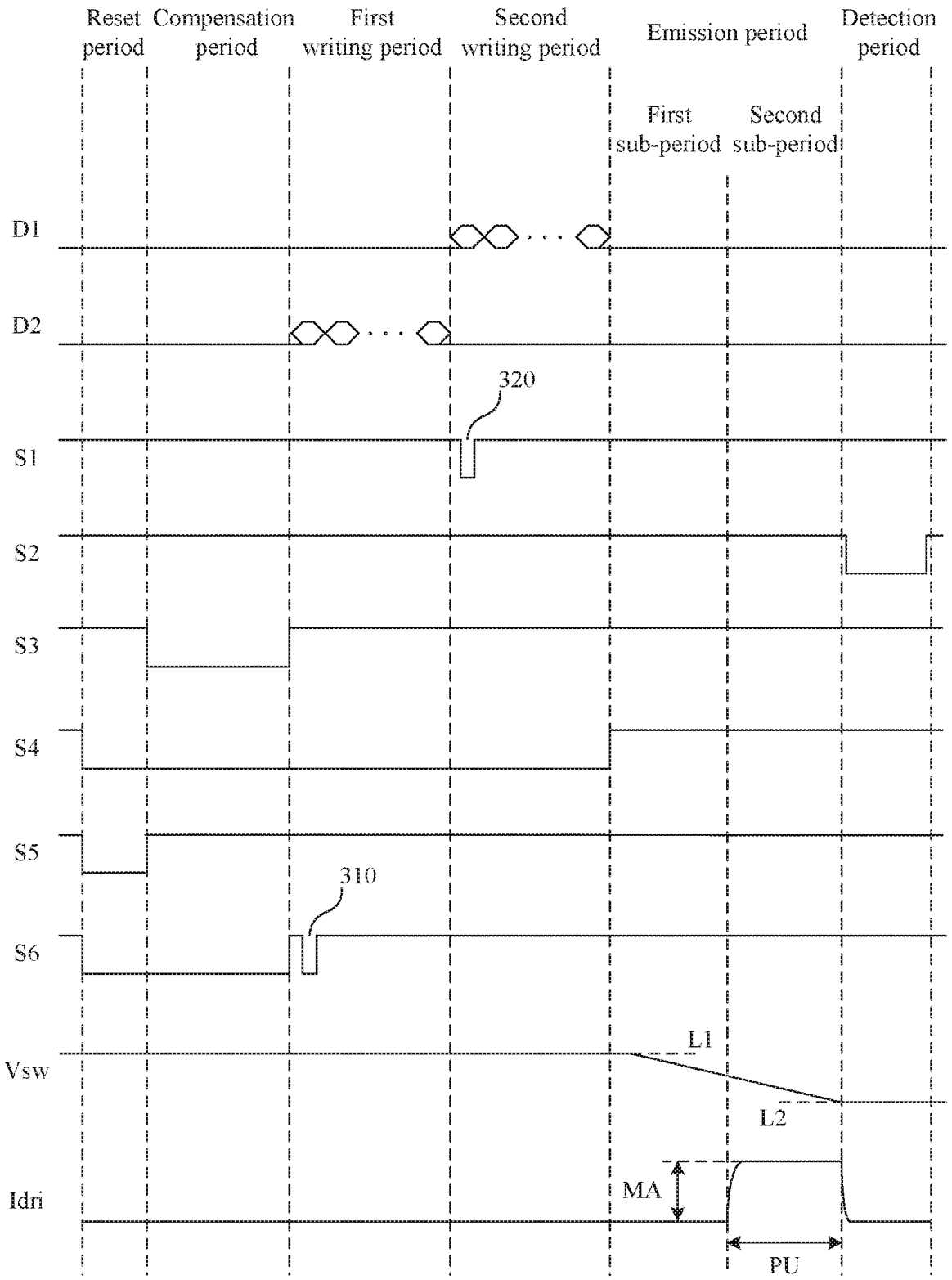
FIG. 3 is a waveform schematic diagram of the plurality of control signals of FIG. 2 according to one embodiment of the present disclosure.
Figure 4A:
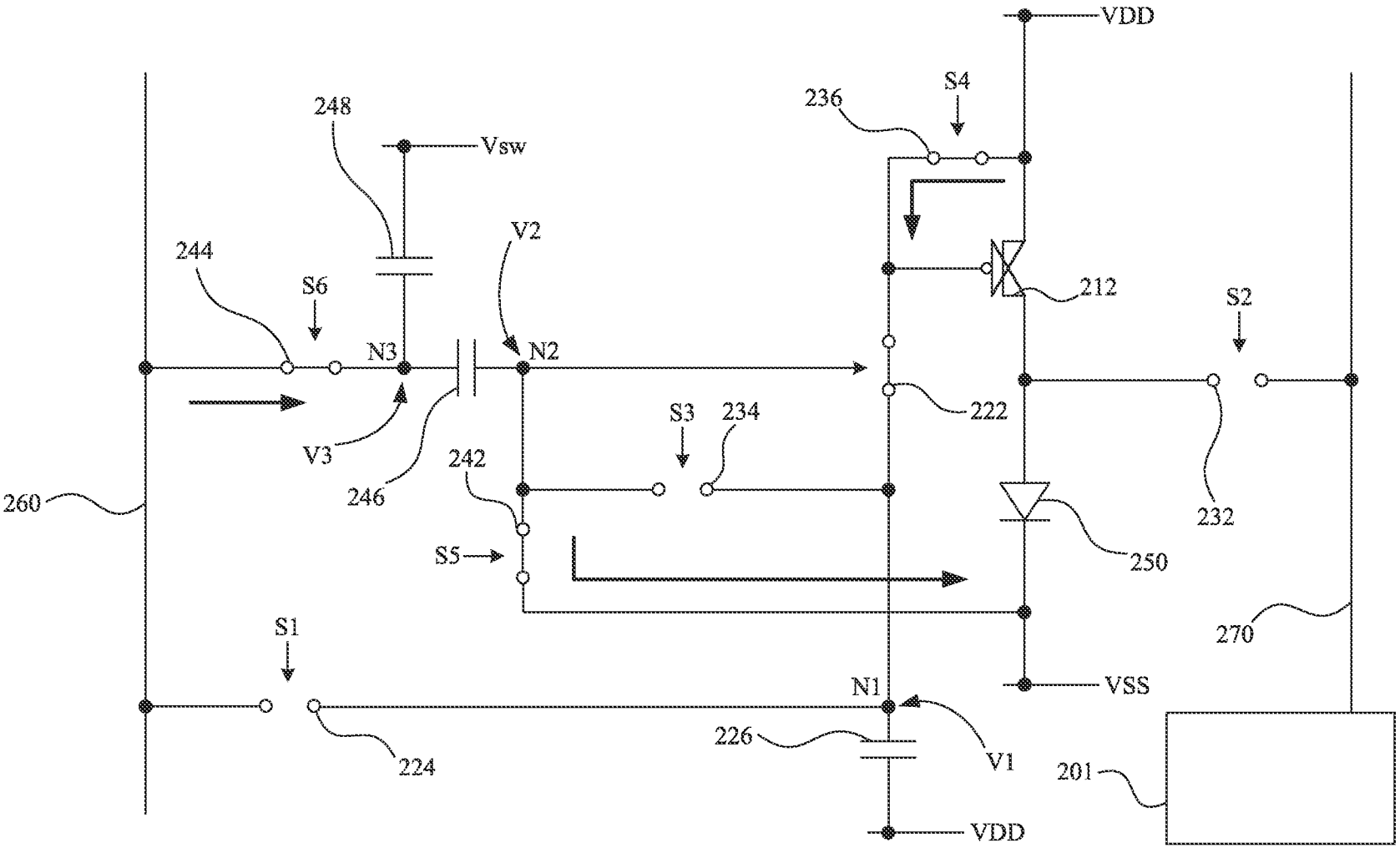
FIG. 4A is a schematic diagram for illustrating operation of an equivalent circuit of the pixel circuit of FIG. 2 in a reset period.
Figure 4B:
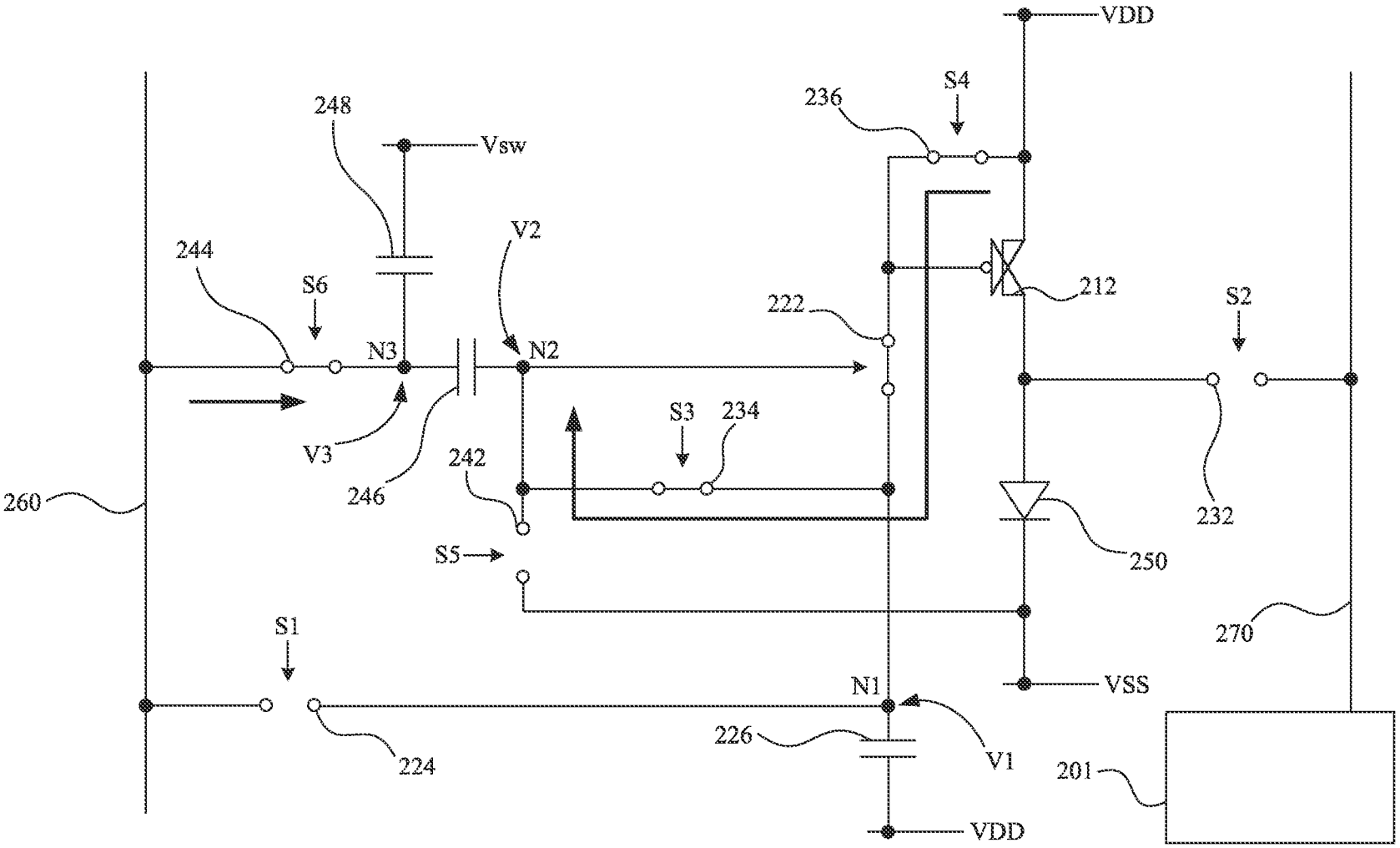
FIG. 4B is a schematic diagram for illustrating operation of the equivalent circuit of the pixel circuit of FIG. 2 in a compensation period.
Figure 4C:
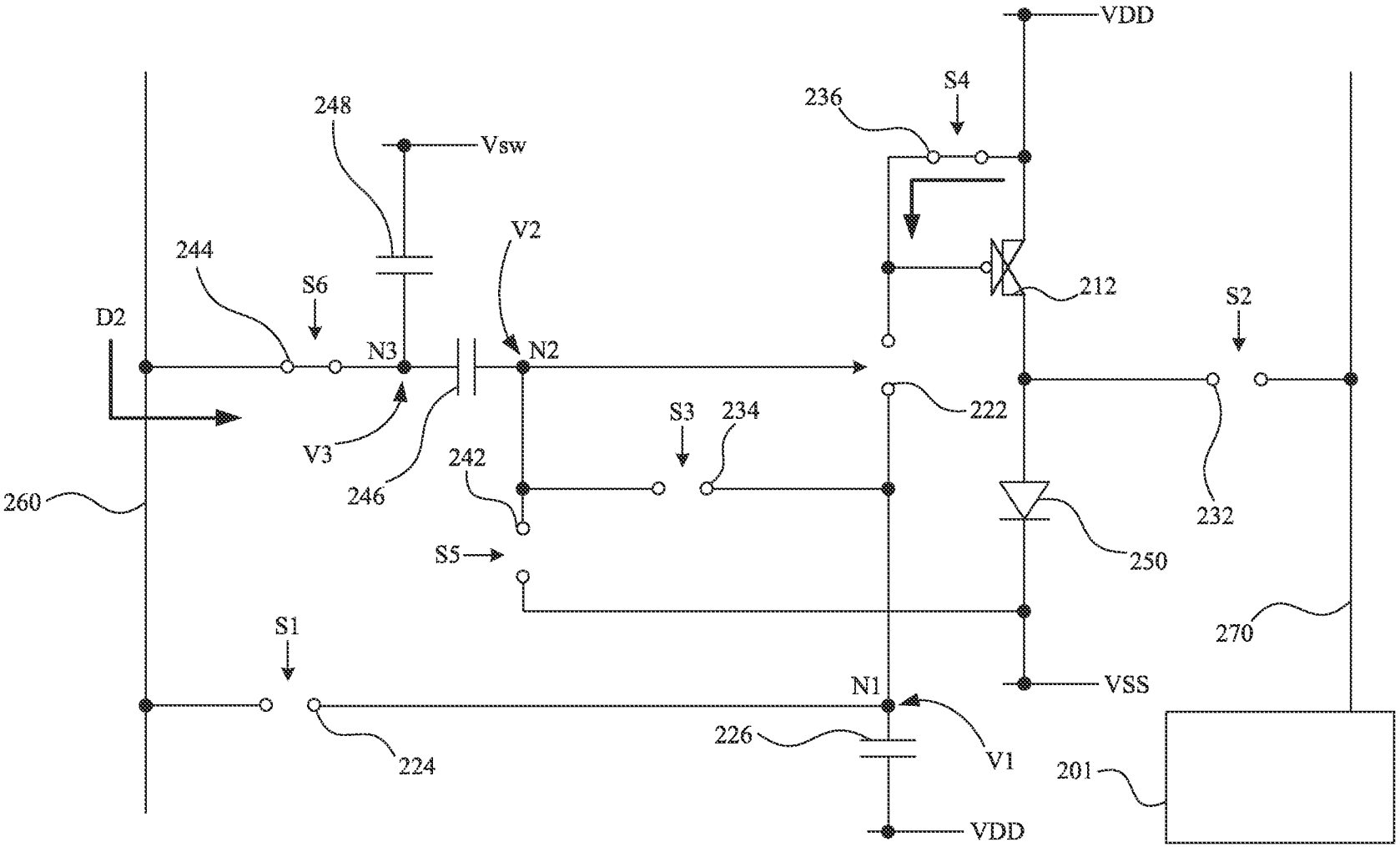
FIG. 4C is a schematic diagram for illustrating operation of the equivalent circuit of the pixel circuit of FIG. 2 in a first writing period.
Figure 4D:
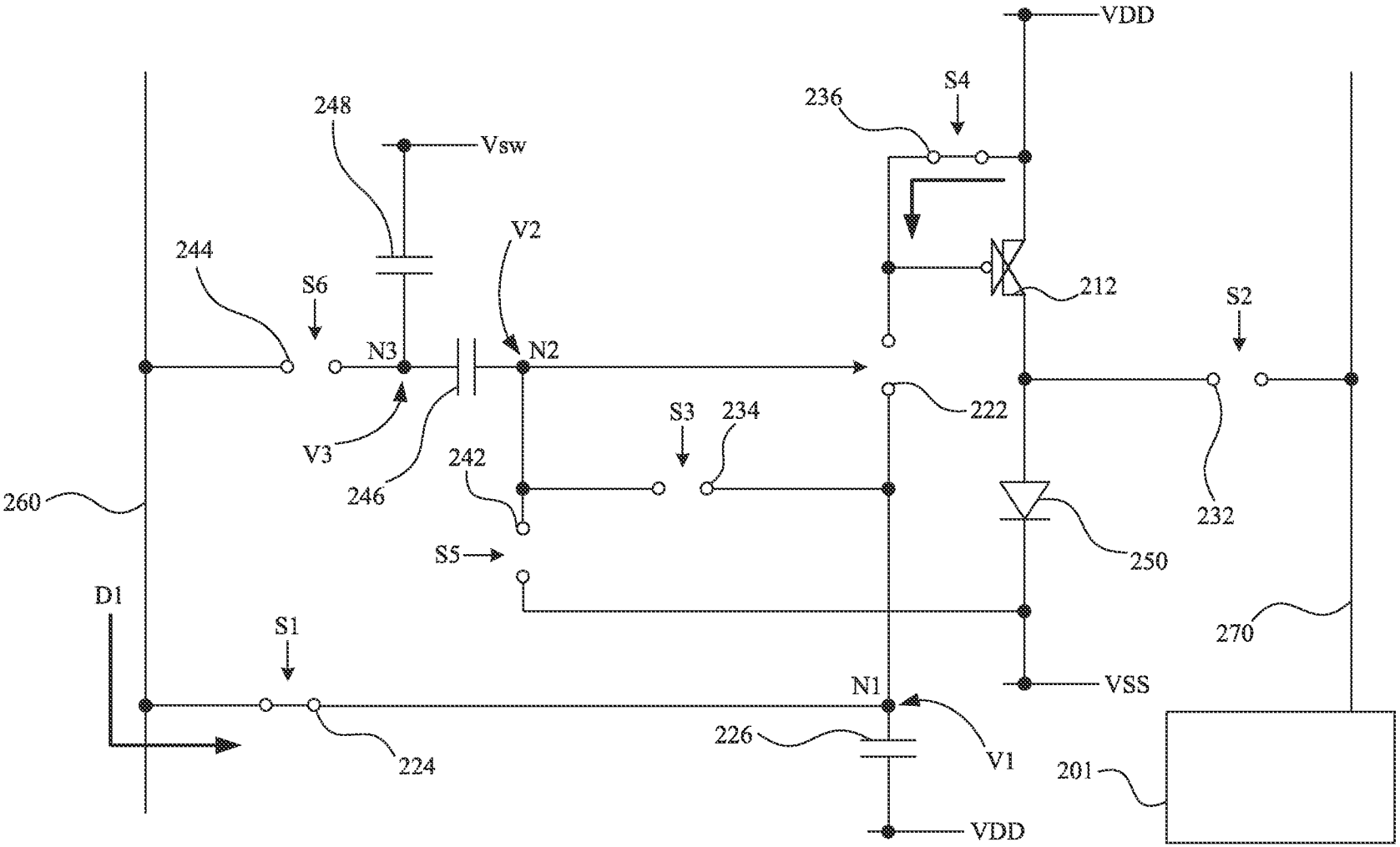
FIG. 4D is a schematic diagram for illustrating operation of the equivalent circuit of the pixel circuit of FIG. 2 in a second writing period.
Figure 4E:
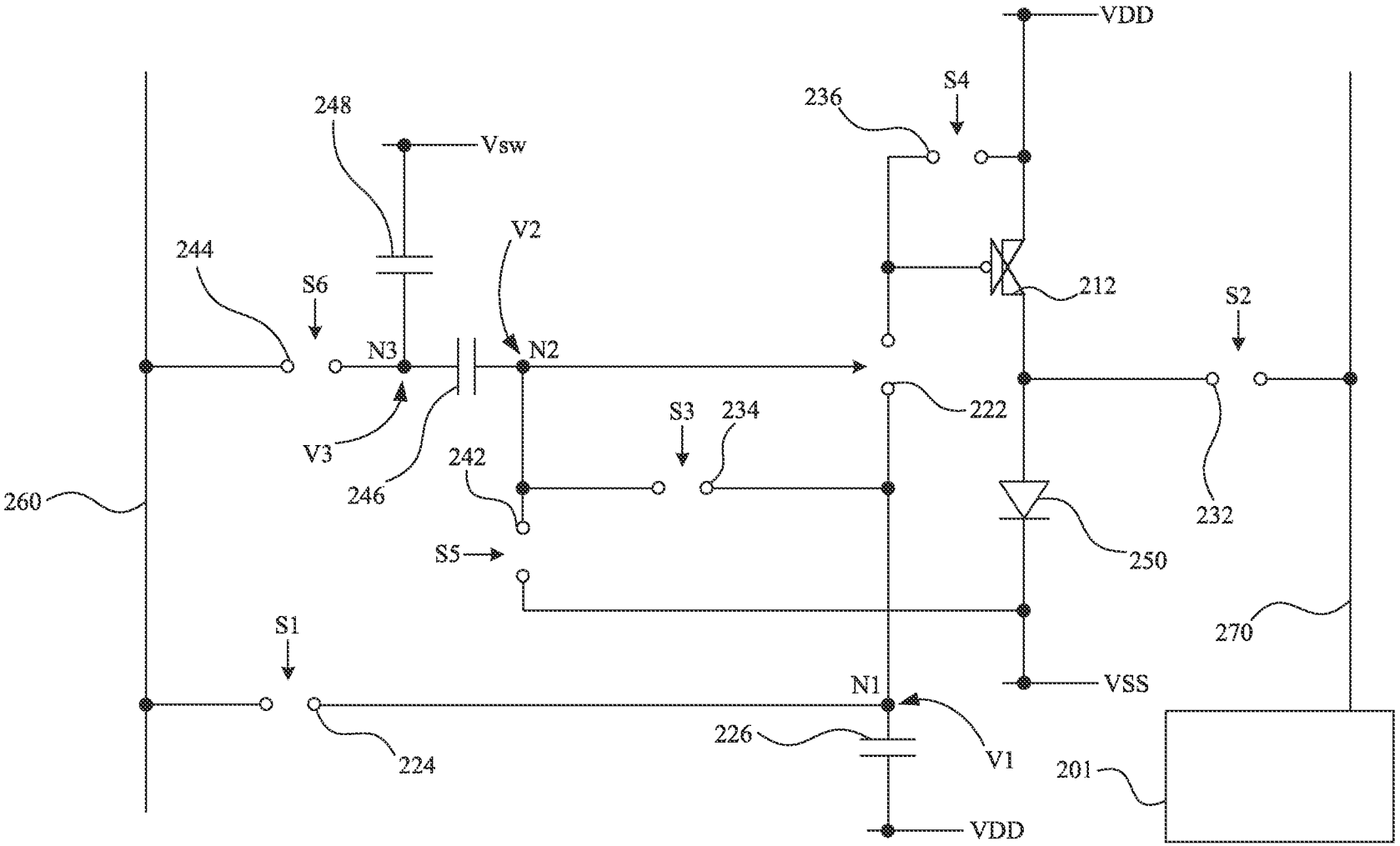
FIG. 4E is a schematic diagram for illustrating operation of the equivalent circuit of the pixel circuit of FIG. 2 in a first sub-period of an emission period.
Figure 4F:
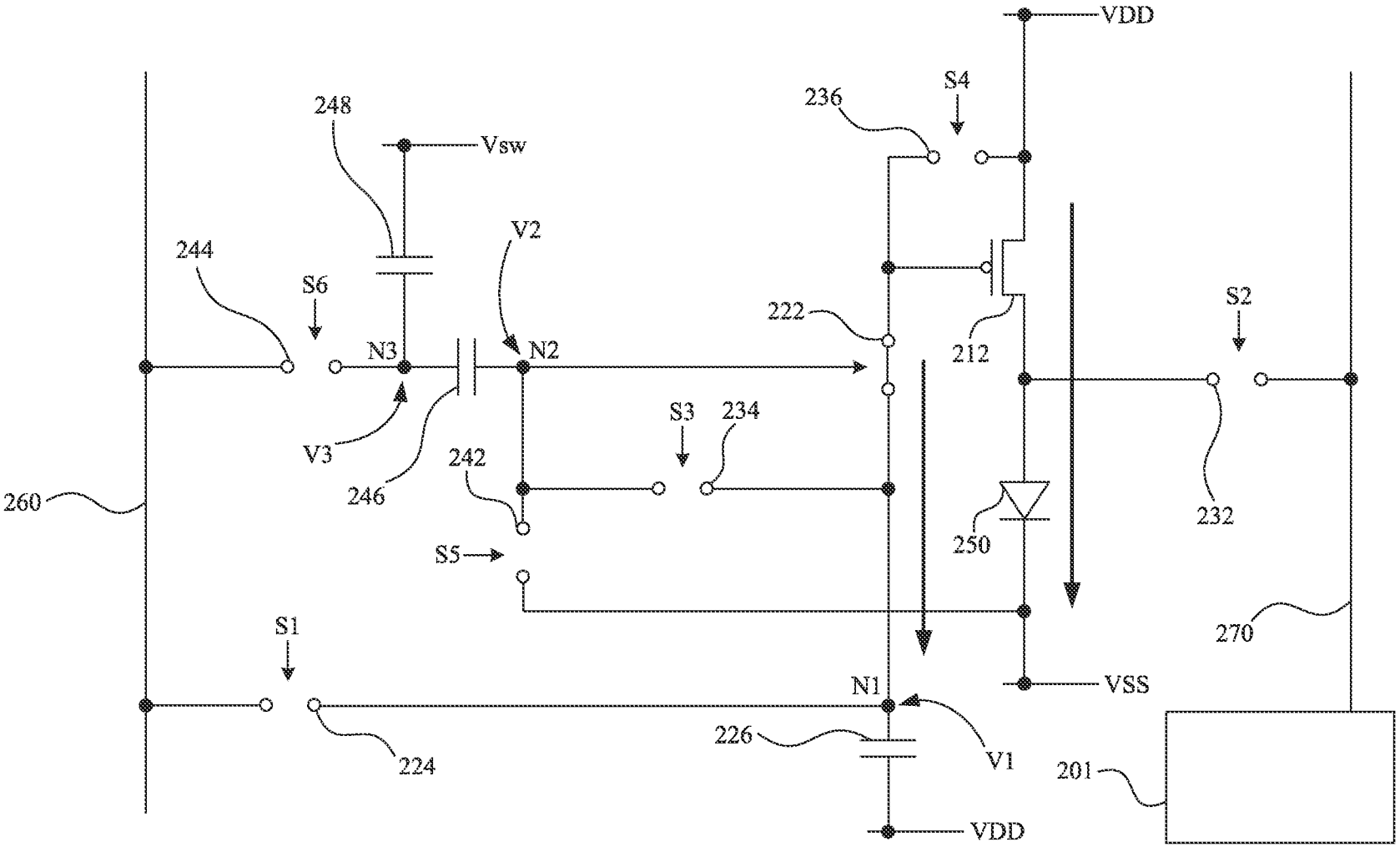
FIG. 4F is a schematic diagram for illustrating operation of the equivalent circuit of the pixel circuit of FIG. 2 in a second sub-period of the emission period.
Figure 4G:
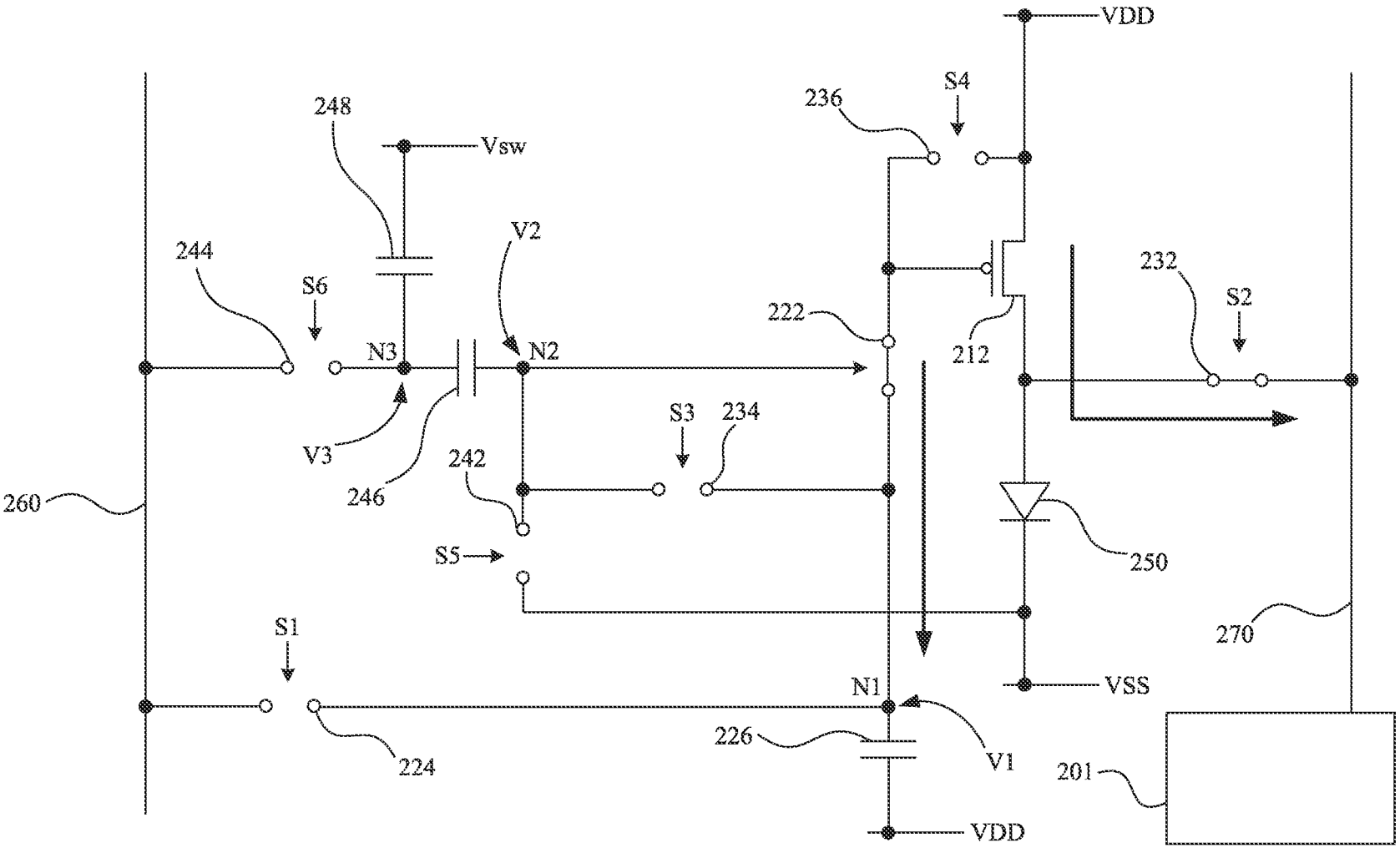
FIG. 4G is a schematic diagram for illustrating operation of the equivalent circuit of the pixel circuit of FIG. 2 in a detection period.

FIG. 3 is a waveform schematic diagram of the plurality of control signals of FIG. 2 according to one embodiment of the present disclosure. FIG. 4A is a schematic diagram for illustrating operation of an equivalent circuit of the pixel circuit 200 of FIG. 2 in a reset period. FIG. 4B is a schematic diagram for illustrating operation of the equivalent circuit of the pixel circuit 200 of FIG. 2 in a compensation period. FIG. 4C is a schematic diagram for illustrating operation of the equivalent circuit of the pixel circuit 200 of FIG. 2 in a first writing period. FIG. 4D is a schematic diagram for illustrating operation of the equivalent circuit of the pixel circuit 200 of FIG. 2 in a second writing period. FIG. 4E is a schematic diagram for illustrating operation of the equivalent circuit of the pixel circuit 200 of FIG. 2 in a first sub-period of an emission period. FIG. 4F is a schematic diagram for illustrating operation of the equivalent circuit of the pixel circuit 200 of FIG. 2 in a second sub-period of the emission period. FIG. 4G is a schematic diagram for illustrating operation of the equivalent circuit of the pixel circuit 200 of FIG. 2 in a detection period.

In the reset period, the first control signal S1, the second control signal S2, and the third control signal S3 have a logic low level (e.g., a high voltage level); and the fourth control signal S4, the fifth control signal S5, and the sixth control signal S6 have a logic high level (e.g., a low voltage level). As shown in FIG. 4A, the first switch 222, the fifth switch 236, the sixth switch 242, and the seventh switch 244 are conducted, and the second switch 224, the third switch 232, and the fourth switch 234 are switched off. A voltage of the control terminal of the driving transistor 212 and the second voltage V2 are set as the system high voltage VDD and the system low voltage VSS, respectively. The third voltage V3 is set to be a ground voltage by the data line 260, the ground voltage is provided by the first data signal D1 or the second data signal D2, but this disclosure is not limited thereto. In one embodiment, the third voltage V3 in the reset period is set to be lower than or equal to a voltage level of the second data signal D2 by which the third node N3 receives in the subsequent first writing period.

In the compensation period, the third control signal S3, the fourth control signal S4, and the sixth control signal S6 have the logic high level; and the first control signal S1, the second control signal S2, and the fifth control signal S5 have the logic low level. As shown in FIG. 4B, the first switch 222, the fourth switch 234, the fifth switch 236, the seventh switch 244 are conducted, and the second switch 224, the third switch 232, and the sixth switch 242 are switched off. The third node N3 is maintained at the ground voltage, and the ground voltage is provided by the first data signal D1 or the second data signal D2. The system high voltage VDD charges the second node N2 until the second voltage V2 approaches to a value illustrated by formula 1.

$$V2=VDD-|Vth1| \quad \text{(Formula 1)}$$

The symbol "Vth1" represents the threshold voltage of the first switch 222. In other words, in the compensation period, the internal compensation circuit 230 uses the fourth switch 234 and the fifth switch 236 to detect the threshold voltage of the first switch 222, and provides the threshold voltage of the first switch 222 to the second nodeN2.

In the first writing period, the fourth control signal S4 has the logic high level; the first control signal S1, the second control signal S2, the third control signal S3, and the fifth control signal S5 have the logic low level. As show in FIG. 4C, the first switch 222, the second switch 224, the third switch 232, the fourth switch 234, and the sixth switch 242 are switched off, and the fifth switch 236 are conducted. The sixth control signal S6 switches to the logic low level, and then provides a pulse 310 having the logic high level to conduct the seventh switch 244, so that the pixel circuit 200 set the third voltage V3 according to the second data signal D2. In this situation, the second voltage V2 changes to a value illustrated by Formula 2 due to the capacitive coupling of the second capacitor 246.

$$V2=VDD-|Vth1|+Vd2 \quad \text{(Formula 2)}$$

The symbol "Vd2" represents the voltage level of the second data signal D2 by which the third node N3 receives when the seventh switch 244 is conducted in the first writing period.

In the second writing period, the fourth control signal S4 has the logic high level; the second control signal S2, the third control signal S3, the fifth control signal S5, and the sixth control signal S6 have the logic low level. As shown in FIG. 4D, the first switch 222, the third switch 232, the fourth switch 234, the sixth switch 242, and the seventh switch 244 are switched off, and the fifth switch 236 is conducted. The first control signal S1 provides a pulse 320 having the logic high level to conduct the second switch 224, so that the amplitude control circuit 220 set the first voltage V1 according to the first data signal D1.

In the emission period, the first control signal S1, the second control signal S2, the third control signal S3, the fourth control signal S4, the fifth control signal S5, and the sixth control signal S6 have the logic low level. The linear varying voltage $V_{SW}$ has a first voltage level L1 during the reset period, the compensation period, the first writing period, and the second writing period. In the emission period, however, the linear varying voltage $V_{SW}$ changes linearly from the first voltage level L1 to the second voltage level L2, so that the second voltage V2 changes linearly from the value illustrated by Formula 2.

In this embodiment, the first voltage level L1 is higher than the second voltage level L2, that is, the second voltage V2 decreases linearly in the emission period from the value illustrated by Formula 2. In the first sub-period of the emission period, the second voltage V2 is higher than the value illustrated by Formula 1. Therefore, as shown in FIG. 4E, the driving transistor 212, the first switch 222, the second switch 224, the third switch 232, the fourth switch 234, the fifth switch 236, the sixth switch 242, and the seventh switch 244 are switched off, so that the driving transistor 212 would not generate the driving current and the lighting element 250 would not emit.

On the other hand, as shown in 4F, when the second voltage V2 is equal to or lower than the value illustrated by Formula 1 in the second sub-period of the emission period, the first switch 222 is switched to the conducted status. In this situation, the amplitude control circuit 220 provides the first voltage V1 to the control terminal of the driving transistor 212 by the first switch 222. Since the capacitance of the first capacitor 226 is far greater than that of the gate capacitor of the driving transistor 212, the driving transistor 212 would operate in the saturation region and generate the driving current illustrated by Formula 3.

$$Idri=\tfrac{1}{2}k(VDD-|Vth2|-Vd1)^2 \quad \text{(Formula 3)}$$

The symbol "Idri" represents the driving current, and the symbol "Vth2" represents the threshold voltage of the driving transistor 212. The symbol "Vd1" represents the voltage level of the first data signal D1 by which the amplitude control circuit 220 receives when the second switch 224 is conducted in the second writing period. The symbol "k" represents the product of the carrier mobility, the gate capacitance per unit area, and the width length ratio of the driving transistor 212.

As can be appreciated from the forgoing descriptions, the amplitude control circuit 220 controls, by the first voltage V1, whether the driving transistor 212 is conducted, so as to determine the magnitude MA of the driving current as shown in FIG. 2. A length of the first sub-period is positively correlated to the second voltage V2 illustrated by Formula 2. On the other hand, a length of the second sub-period is negatively correlated to the second voltage V2 illustrated by Formula 2. The pulse width control circuit 240 controls, by the second voltage V2, a time length the first switch 222 is conducted in the emission period, so as to determine the pulse width PU of the driving current in the emission period as shown in FIG. 2.

In addition, the second voltage V2 varies with the threshold voltage of the first switch 222, and thus the time length which the first switch 222 is conducted in the emission period is immune to the variation of the threshold voltage. For example, as illustrated by Formula 2, when the first switch 222 needs to be conducted by a lower control terminal voltage due to having a higher threshold voltage, the second voltage V2 is set to be lower in the compensation period, and vice versa.

Notably, the pixel circuit 200 stores the system high voltage VDD at the first terminal of the first switch 222 in the first writing period and the second writing period, and then disconnects the first terminal of the first switch 222 with the power line providing the system high voltage VDD in the emission period. Therefore, during the emission period, the conduction time of the first switch 222 is immune to the variation of the system high voltage VDD.

In the detection period, the second control signal S2 has the logic high level; and the first control signal S1, the third control signal S3, the fourth control signal S4, the fifth control signal S5, and the sixth control signal S6 have the logic low level. As shown in FIG. 4G, the driving transistor 212, the first switch 222, and the third switch 232 are conducted, and the second switch 224, the fourth switch 234, the fifth switch 236, the sixth switch 242, and the seventh switch 244 are switched off. The driving current flows to the external compensation circuit 201 through the third switch 232. The external compensation circuit 201 compares the driving current with a predetermined value, and adjusts the value of the first data signal D1 by which the pixel circuit 200 receives in the second writing period according to the comparison result. Therefore, the magnitude of the driving current is immune to the variation of the threshold voltage of the driving transistor 212. For example, when the driving transistor 212 needs to be conducted by a lower control terminal voltage due to having a higher threshold voltage, the first data signal D1 is set to be lower in the second writing period, and vice versa.

Figure 5:
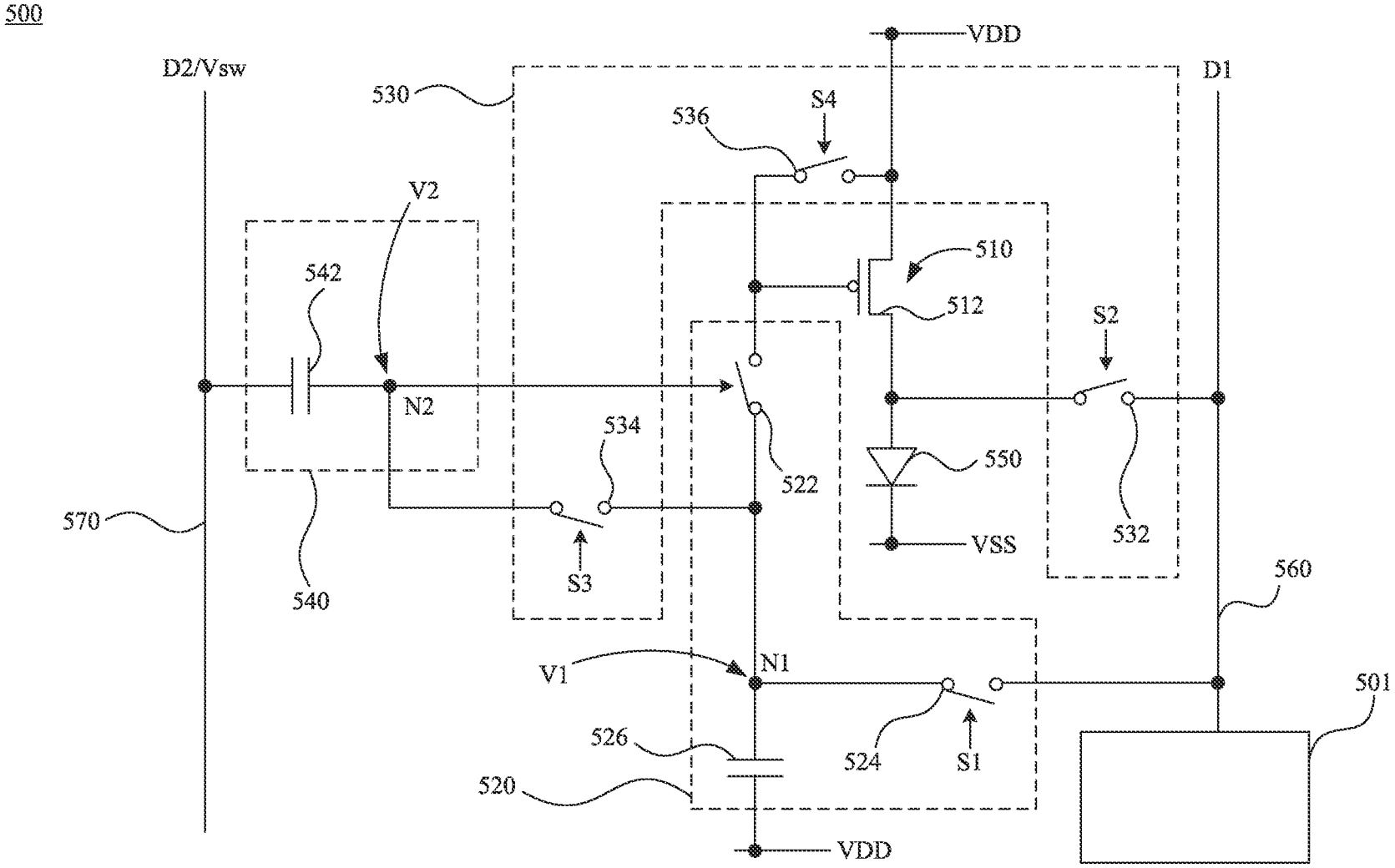
FIG. 5 is a functional block diagram of a pixel circuit according to one embodiment of the present disclosure.

FIG. 5 is a functional block diagram of a pixel circuit 500 according to one embodiment of the present disclosure. The pixel circuit 500 comprises a current source 510, an amplitude control circuit 520, an internal compensation circuit 530, a pulse width control circuit 540, and a lighting element 550. The current source 510 and the lighting element 550 of FIG. 5 may be the current source 110 and the lighting element 150 of FIG. 1, respectively, and the current source 510 comprises a driving transistor 512 configured to generate the driving current. A first terminal of the driving transistor 512 is configured to receive the system high voltage VDD. The second terminal of the driving transistor 512 is coupled with a first terminal (e.g., the anode) of the lighting element 550. The second terminal (e.g., the cathode) of the lighting element 550 is configured to receive the system low voltage VSS.

The amplitude control circuit 520 of FIG. 5 may be the amplitude control circuit 120 of FIG. 1, and comprises a first switch 522, a second switch 524, a first capacitor 526, and a first node N1 configured to provide a first voltage V1. The first terminal of the first switch 522 is coupled with a control terminal of the driving transistor 512. A second terminal of the first switch 522 is coupled with the first node N1. A first terminal of the second switch 524 is coupled with the first node N1. A second terminal of the second switch 524 is configured to receive the first data signal D1 from the transmission line 560. A control terminal of the second switch 524 is configured to receive the first control signal S1. A first terminal of the first capacitor 526 is coupled with the first node N1. A second terminal of the first capacitor 526 is configured to receive the system high voltage VDD.

The internal compensation circuit 530 of FIG. 5 may be the internal compensation circuit 130 of FIG. 1, and comprises a third switch 532, a fourth switch 534, and a fifth switch 536. A first terminal of the third switch 532 is coupled with the second terminal of the driving transistor 512. A second terminal of the third switch 532 is coupled with the external compensation circuit 501 through the transmission line 560. A control terminal of the third switch 532 is configured to receive the second control signal S2. A first terminal of the fourth switch 534 is coupled with the pulse width control circuit 540. A second terminal of the fourth switch 534 is coupled with the first node N1. A control terminal of the fourth switch 534 is configured to receive the third control signal S3. A first terminal of the fifth switch 536 is coupled with the control terminal of the driving transistor 512. A second terminal of the fifth switch 536 is coupled with the first terminal of the driving transistor 512. A control terminal of the fifth switch 536 is configured to receive the fourth control signal S4.

The pulse width control circuit 540 of FIG. 5 may be the pulse width control circuit 140 of FIG. 1, and comprises a second capacitor 542 and a second node N2 configured to provide a second voltage V2. A first terminal of the second capacitor 542 is configured to receive the second data signal D2 and the linear varying voltage $V_{SW}$ from the data line 570. A second terminal of the second capacitor 542 is coupled with the second node N2.

The external compensation circuit 501 of FIG. 5 may be the external compensation circuit 101 of FIG. 1, and configured to receive the driving current from the internal compensation circuit 530 to detect the threshold voltage of the driving transistor 512. The external compensation circuit 501 may adaptively adjust the first data signal D1 according to the threshold voltage of the driving transistor 512. In practice, the external compensation circuit 501 may be realized by the ASIC, and also may be realized by other hardware component capable of executing commands (e.g., the FPGA, the CPU, or the microprocessor).

In addition, the plurality of switches and the driving transistor 512 may be realized by P-type transistors of any suitable category, such as the P-type TFTs, P-type MOSFETs, etc. The lighting element 550 may be realized by the Micro LED or the OLED.

Figure 6:
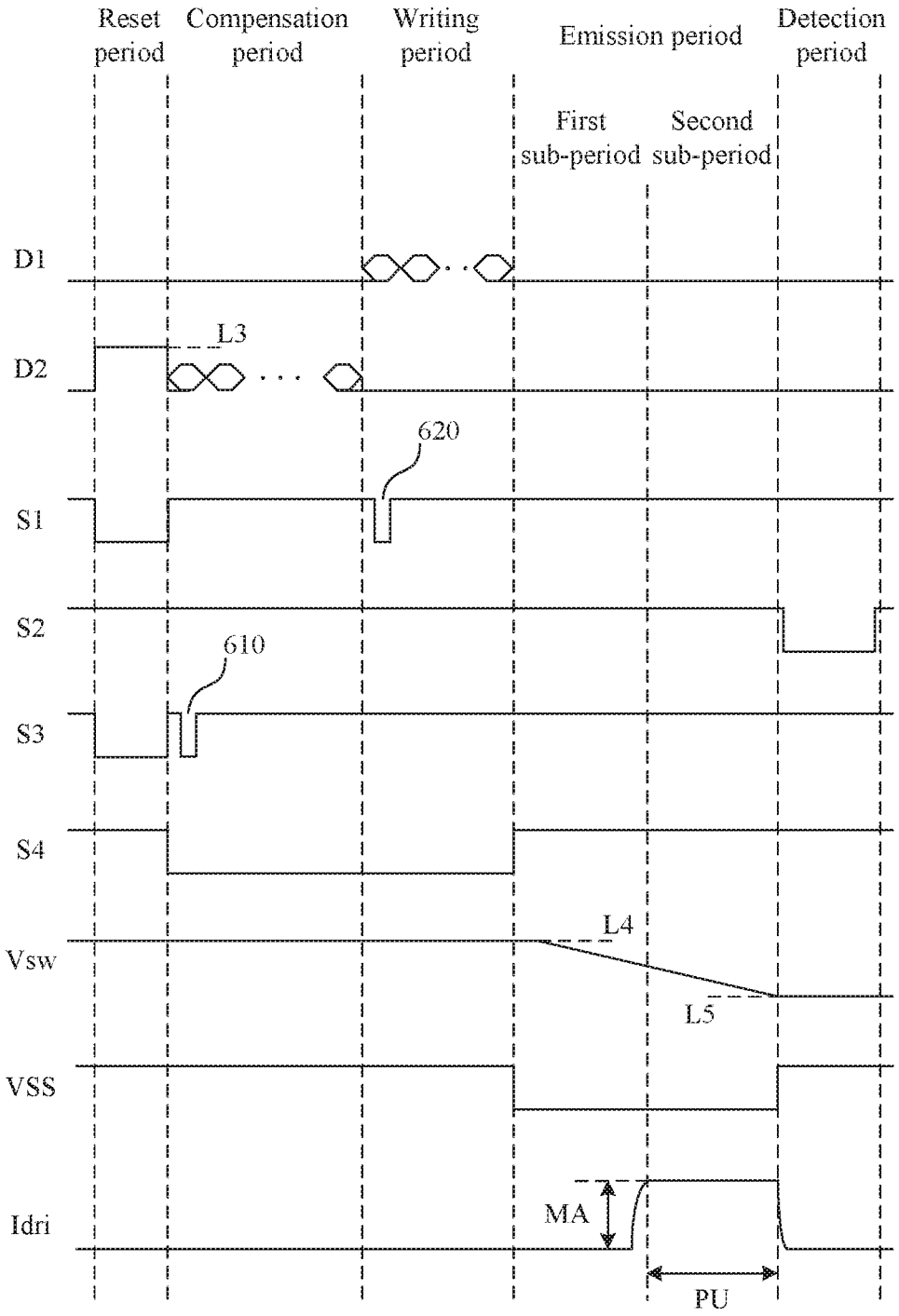
FIG. 6 is a waveform schematic diagram of the plurality of control signals of FIG. 5 according to one embodiment of the present disclosure.
Figure 7A:
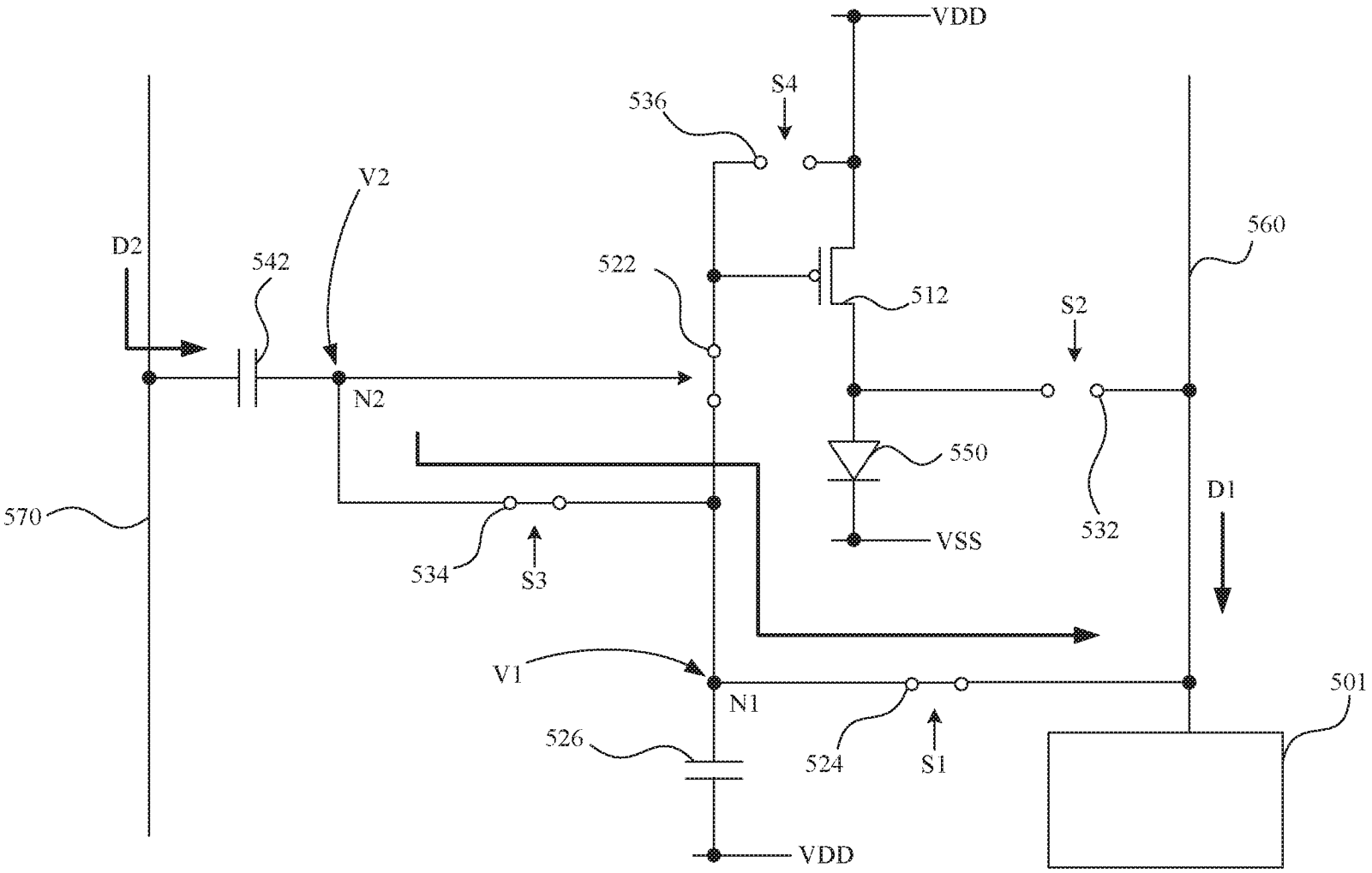
FIG. 7A is a schematic diagram for illustrating operation of an equivalent circuit of the pixel circuit of FIG. 5 in a reset period.
Figure 7B:
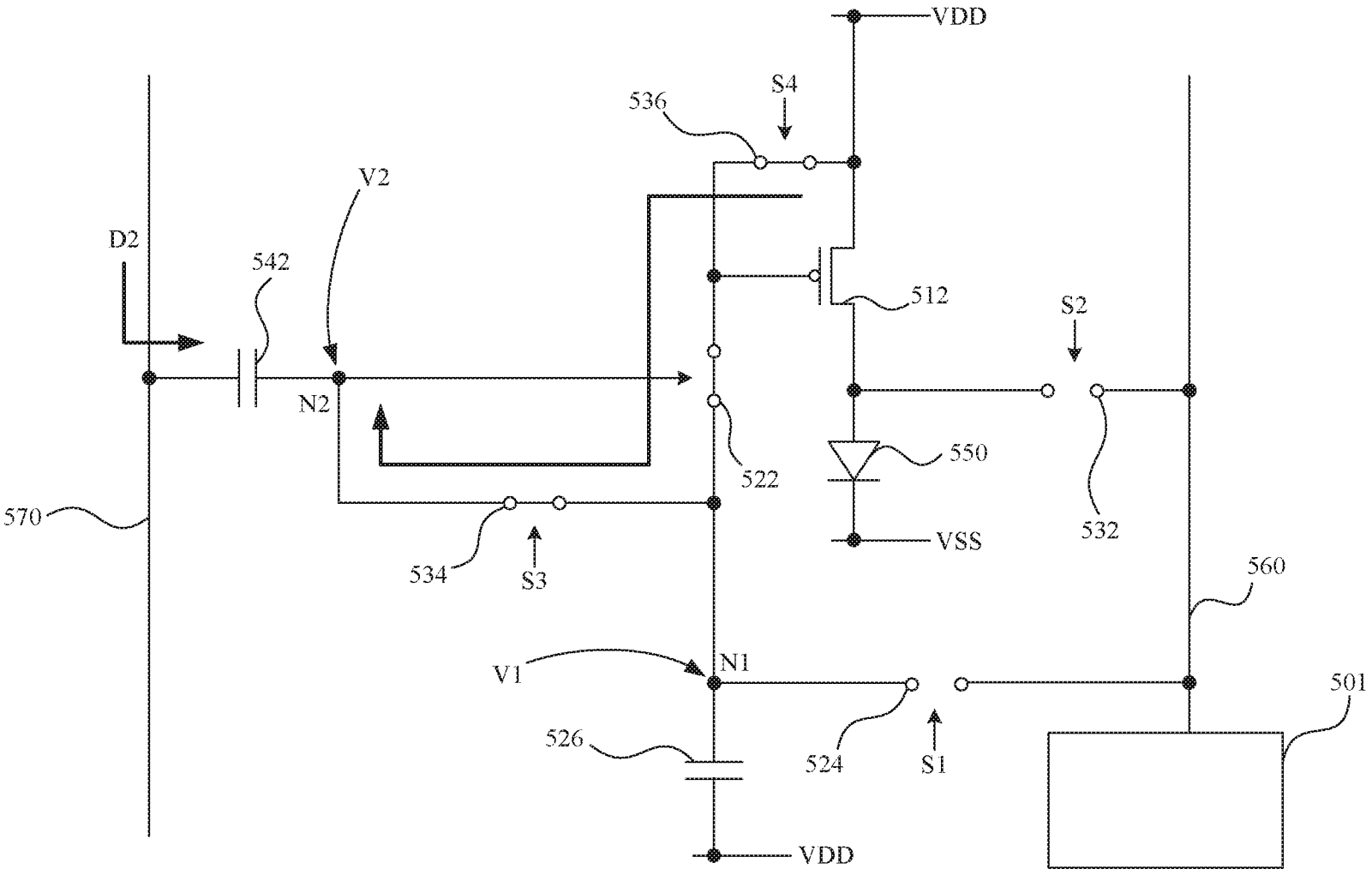
FIG. 7B is a schematic diagram for illustrating operation of the equivalent circuit of the pixel circuit of FIG. 5 in a compensation period.
Figure 7C:
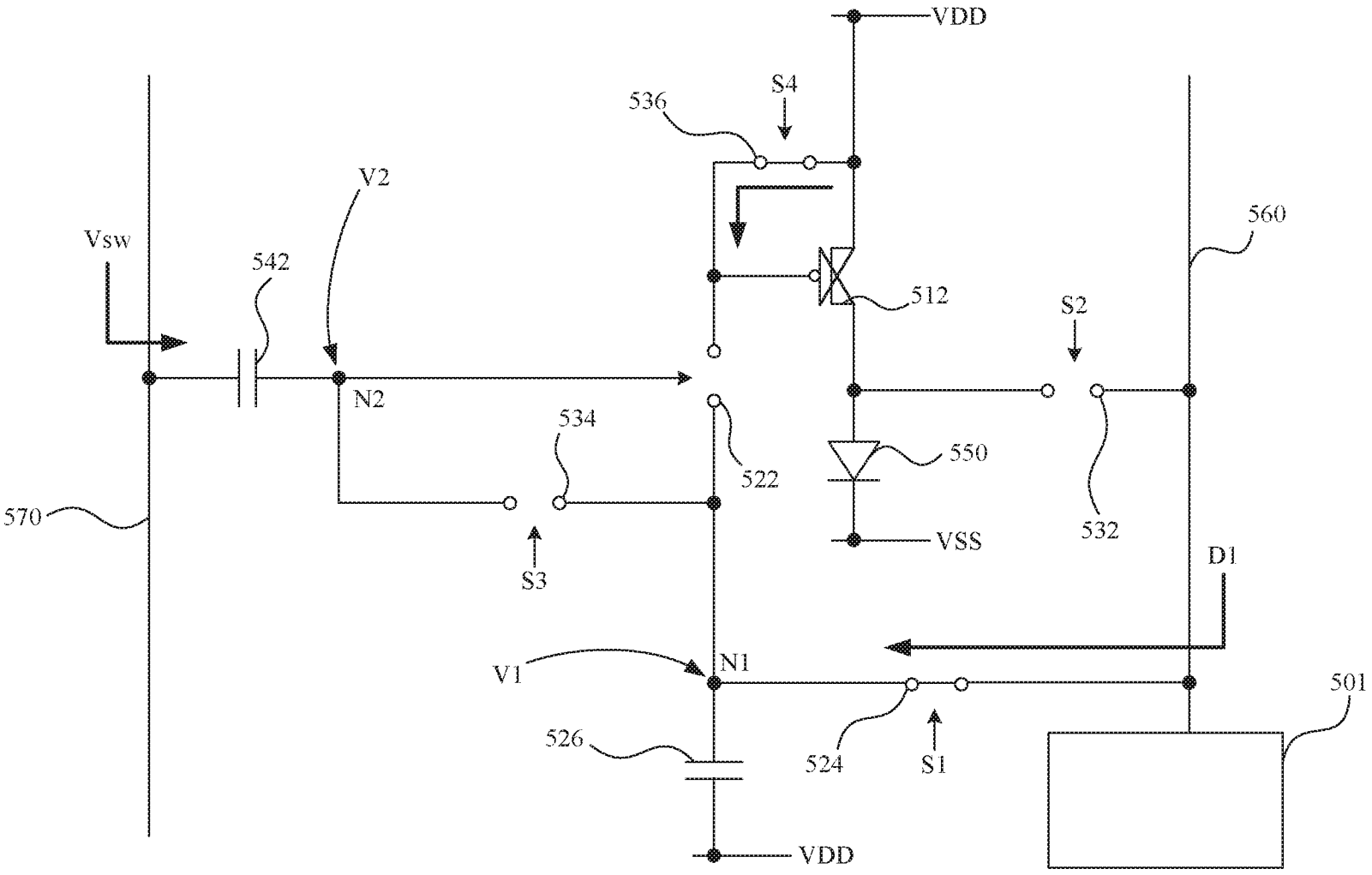
FIG. 7C is a schematic diagram for illustrating operation of the equivalent circuit of the pixel circuit of FIG. 5 in a writing period.
Figure 7D:
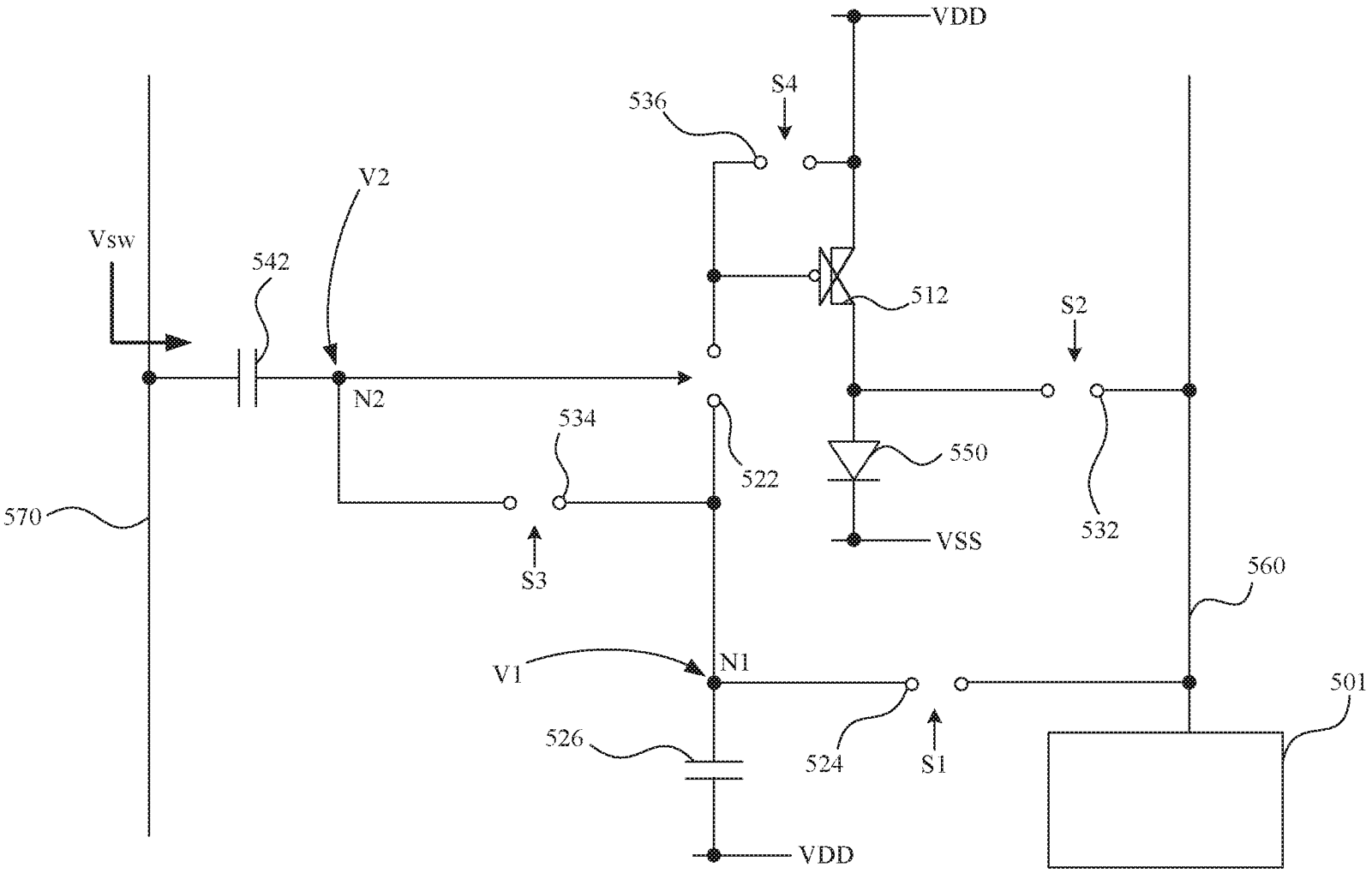
FIG. 7D is a schematic diagram for illustrating operation of the equivalent circuit of the pixel circuit of FIG. 5 in a first sub-period of an emission period.
Figure 7E:
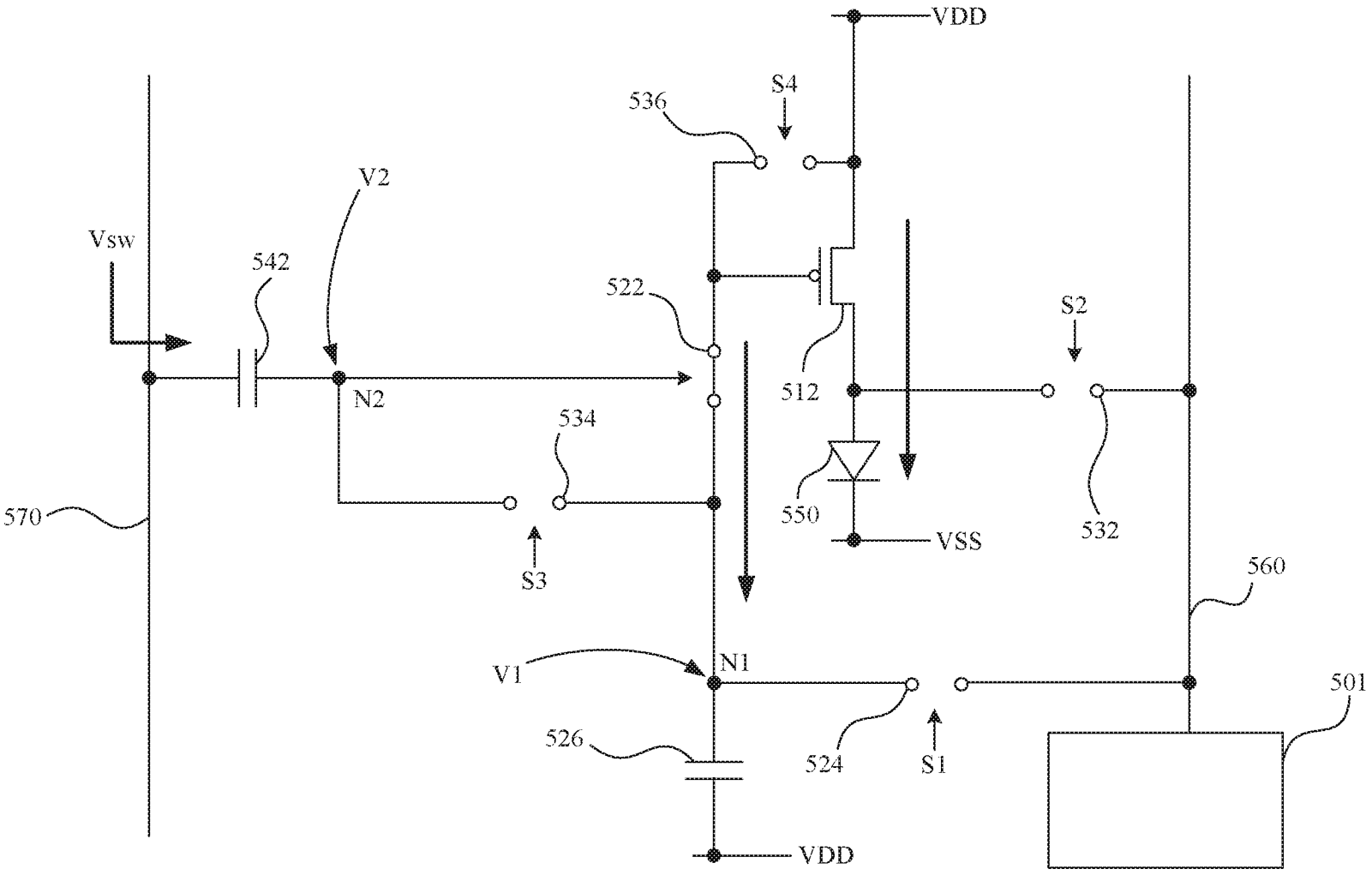
FIG. 7E is a schematic diagram for illustrating operation of the equivalent circuit of the pixel circuit of FIG. 5 in a second sub-period of the emission period.
Figure 7F:
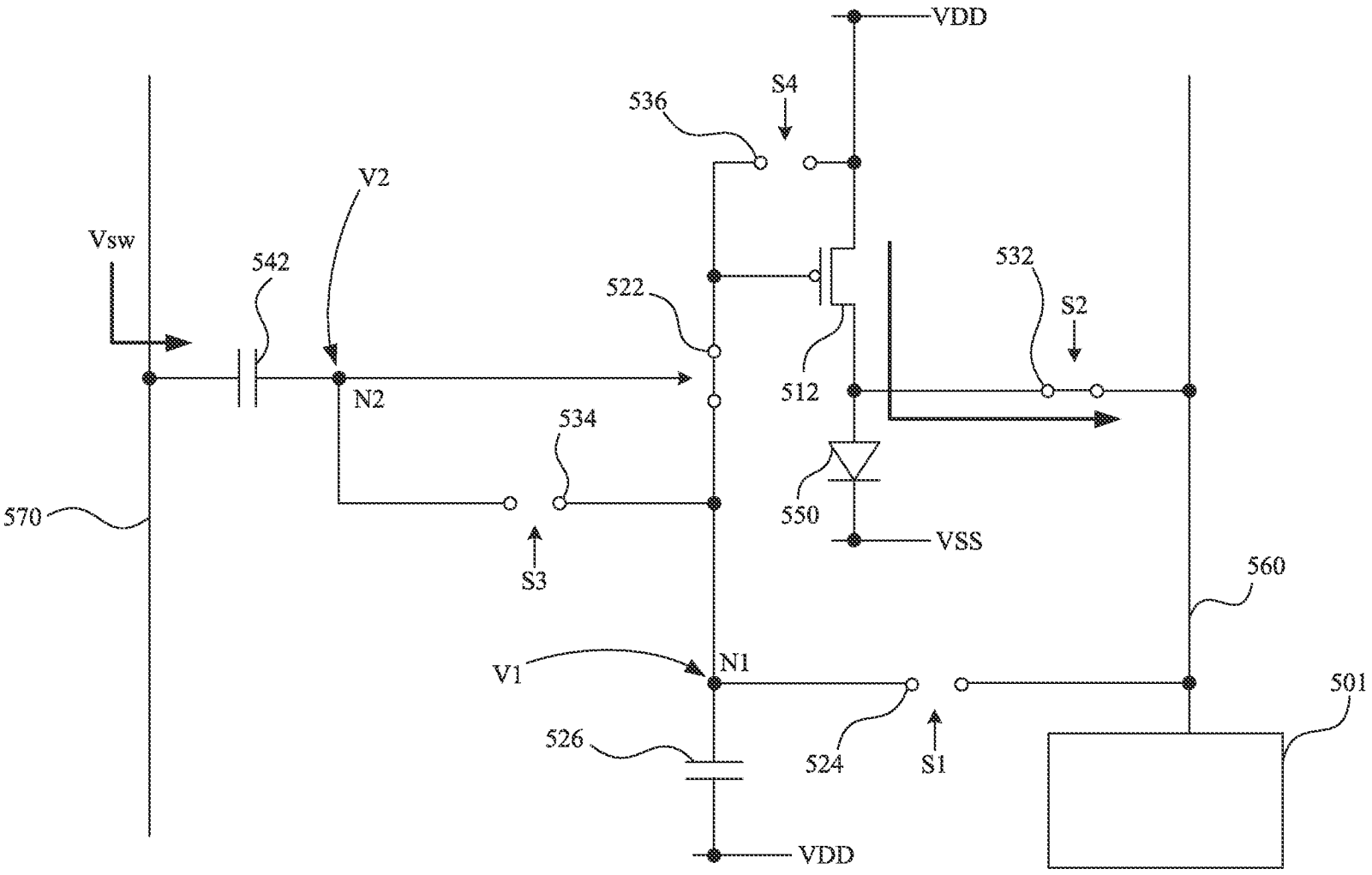
FIG. 7F is a schematic diagram for illustrating operation of the equivalent circuit of the pixel circuit of FIG. 5 in a detection period.

FIG. 6 is a waveform schematic diagram of the plurality of control signals of FIG. 5 according to one embodiment of the present disclosure. FIG. 7A is a schematic diagram for illustrating operation of an equivalent circuit of the pixel circuit 500 of FIG. 5 in a reset period. FIG. 7B is a schematic diagram for illustrating operation of the equivalent circuit of the pixel circuit 500 of FIG. 5 in a compensation period. FIG. 7C is a schematic diagram for illustrating operation of the equivalent circuit of the pixel circuit 500 of FIG. 5 in a writing period. FIG. 7D is a schematic diagram for illustrating operation of the equivalent circuit of the pixel circuit 500 of FIG. 5 in a first sub-period of an emission period. FIG. 7E is a schematic diagram for illustrating operation of the equivalent circuit of the pixel circuit 500 of FIG. 5 in a second sub-period of the emission period. FIG. 7F is a schematic diagram for illustrating operation of the equivalent circuit of the pixel circuit 500 of FIG. 5 in a detection period.

In the reset period, the first control signal S1 and the third control signal S3 have the logic high level (e.g., a low voltage level); and the second control signal S2 and the fourth control signal S4 have the logic low level (e.g., a high voltage level). As shown in FIG. 7A, the first switch 522, the second switch 524, and the fourth switch 534 are conducted, and the third switch 532 and the fifth switch 536 are switched off. The second voltage V2 is set to be the ground voltage by the transmission line 560, the ground voltage is provided by the first data signal D1, but this disclosure is not limited thereto. In the reset period of one embodiment, the second voltage V2 is set to be lower than a value illustrated subsequently by Formula 4.

In addition, the first terminal of the second capacitor 542 is set to be a third voltage level L3 by the data line 570, the third voltage level L3 is provided by the second data signal D2, but this disclosure is not limited thereto. The third voltage level L3 is higher than a voltage level of the second data signal D2 by which the second capacitor 542 receives in the subsequent compensation period.

In the compensation period, the fourth control signal S4 has the logic high level; and the first control signal S1 and the second control signal S2 have the logic low level. As shown in FIG. 7B, the first switch 522 and the fifth switch 536 are conducted, and the second switch 524 and the third switch 532 are switched off. The third control signal S3 switches to the logic low level, and then provides a pulse 610 having the logic high level to conduct the fourth switch 534. Therefore, the system high voltage VDD charges the second node N2 until the second voltage V2 approaches to the value illustrated by Formula 4.

$$V2=VDD-|Vth3| \quad \text{(Formula 4)}$$

The symbol "Vth3" represents the first switch 522. In other words, in the compensation period, the internal compensation circuit 530 uses the fourth switch 534 and the fifth switch 536 to detect the threshold voltage of the first switch 522, and provides the threshold voltage of the first switch 522 to the second node N2.

When the fourth switch 534 is conducted, the data line 570 provides the corresponding second data signal D2 to the second capacitor 542, so that a voltage difference between first and second terminals of the second capacitor 542 is "VDD−|Vth3|−Vd3". The symbol "Vd3" represents a voltage level of the second data signal D2 by which the first terminal of the second capacitor 542 receives when the fourth switch 534 is conducted. Notably, when the fourth switch 534 is switched back to the switched-off status, the second terminal of the second capacitor 542 is floating so that the voltage difference between the first and second terminals of the second capacitor 542 remain constant in the subsequent operation periods.

In the writing period, the second control signal S2 and the third control signal S3 have the logic low level, the fourth control signal S4 has the logic high level. As shown in FIG. 7C, the fifth switch 536 is conducted, and the first switch 522, the third switch 532, and the fourth switch 534 are switched off. The first control signal S1 provides a pulse 620 having the logic high level to conduct the second switch 524, so that the amplitude control circuit 520 sets the first voltage V1 according to the first data signal D1. In this period, the pulse width control circuit 540 receives the linear varying voltage $V_{SW}$ having a fourth voltage level L4 from the data line 570, so that the second voltage V2 has a value illustrated by Formula 5.

$$V2=VDD-|Vth3|+L4-Vd3 \quad \text{(Formula 5)}$$

In one embodiment, the fourth voltage level L4 is higher than or equal to the voltage level of the second data signal D2 by which the pulse width control circuit 540 receives in the compensation period.

In the emission period, the first control signal S1, the second control signal S2, the third control signal S3, and the fourth control signal S4 have the logic low level. The linear varying voltage $V_{SW}$ changes linearly from the fourth voltage level L4 to a fifth voltage level L5, so that the second voltage V2 also changes linearly. Notably, the system low voltage VSS has a high voltage level during the reset, compensation, and writing periods to switch off the lighting element 550, and the system low voltage VSS switches to a low voltage level in the emission period to conduct the lighting element 550.

In this embodiment, the fourth voltage level L4 is higher than the fifth voltage level L5, and thus the second voltage V2 decreases linearly in the emission period from the value illustrated by Formula 5. In the first sub-period of the emission period, the second voltage V2 is higher than the value illustrated by Formula 4. Therefore, as shown in FIG. 7D, the driving transistor 512, the first switch 522, the second switch 524, the third switch 532, the fourth switch 534, and the fifth switch 536 are switched off, so that the driving transistor 512 would not generate the driving current and the lighting element 550 would not emit.

On the other hand, as shown in FIG. 7E, when the second voltage V2 in the second sub-period is lower than or equal to the value illustrated by Formula 5, the first switch 222 is switched to the conducted status. In this situation, the amplitude control circuit 520 provides the first voltage V1 to the control terminal of the driving transistor 512 by the first switch 522. Since the capacitance of the first capacitor 526 is far greater than that of the gate capacitor of the driving transistor 512, the driving transistor 512 would operate in the saturation region and generate the driving current illustrated by Formula 6.

$$Idri=\tfrac{1}{2}k(VDD-|Vth4|-Vd4)^2 \quad \text{(Formula 6)}$$

The symbol "Idri" represents the driving current, and the symbol "Vth4" represents the threshold voltage of the driving transistor 512. The symbol "Vd4" represents the voltage level of the first data signal D1 by which the amplitude control circuit 520 receives when the second switch 524 is conducted in the writing period. The symbol "k" represents the product of the carrier mobility, the gate capacitance per unit area, and the width length ratio of the driving transistor 512.

As can be appreciated from the forgoing descriptions, the amplitude control circuit 520 controls, by the first voltage V1, whether the driving transistor 512 is conducted, so as to determine the magnitude MA of the driving current as shown in FIG. 6. The length of the first sub-period is positively correlated to the second voltage V2 illustrated by Formula 5. On the other hand, the length of the second sub-period is negatively correlated to the second voltage V2 illustrated by Formula 5. The pulse width control circuit 540 controls, by the second voltage V2, the time length the first switch 522 is conducted in the emission period, so as to determine the pulse width PU of the driving current in the emission period as shown in FIG. 6.

In addition, the second voltage V2 varies with the threshold voltage of the first switch 522, and thus the conduction time of the first switch 522 in the emission period is immune to the variation of the threshold voltage. The pixel circuit 500 stores the system high voltage VDD at the first terminal of the first switch 522 in the writing period, and then disconnects the first terminal of the first switch 522 with the power line providing the system high voltage VDD in the emission period. Therefore, in the emission period, the conduction time of the first switch 522 is immune to the variation of the system high voltage VDD.

In the detection period, the second control signal S2 has the logic high level; the first control signal S1, second control signal S2, and the third control signal S3 have the logic low level; and the system low voltage VSS has the high voltage level. Therefore, as shown in FIG. 7F, the driving transistor 512, the first switch 522, and the third switch 532 are conducted, and the second switch 524, the fourth switch 534, the fifth switch 536, and the lighting element 550 are switched off. The driving current flows to the external compensation circuit 501 through the third switch 532. The external compensation circuit 501 compares the driving current and a predetermined value, and adjusts the value of the first data signal D1 by which the pixel circuit 500 receives in the writing period according to the comparison results. Therefore, the magnitude of the driving current is immune to the variation of the threshold voltage of the driving transistor 512.

The switches in the plurality of foregoing embodiments also may be realized by N-type transistors of any suitable category. For example, the second switch 224, the third switch 232, the fourth switch 234, the fifth switch 236, the sixth switch 242, and the seventh switch 244 of the pixel circuit 200 of FIG. 2 may be realized by N-type transistors, and may be controlled by signals opposite to corresponding signals of FIG. 3. As another example, the second switch 524, the third switch 532, the fourth switch 534, and the fifth switch 536 of pixel circuit 500 of FIG. 5 may be realized by N-type transistors, and may be controlled by signals opposite to corresponding signals of FIG. 6.

Figure 8:
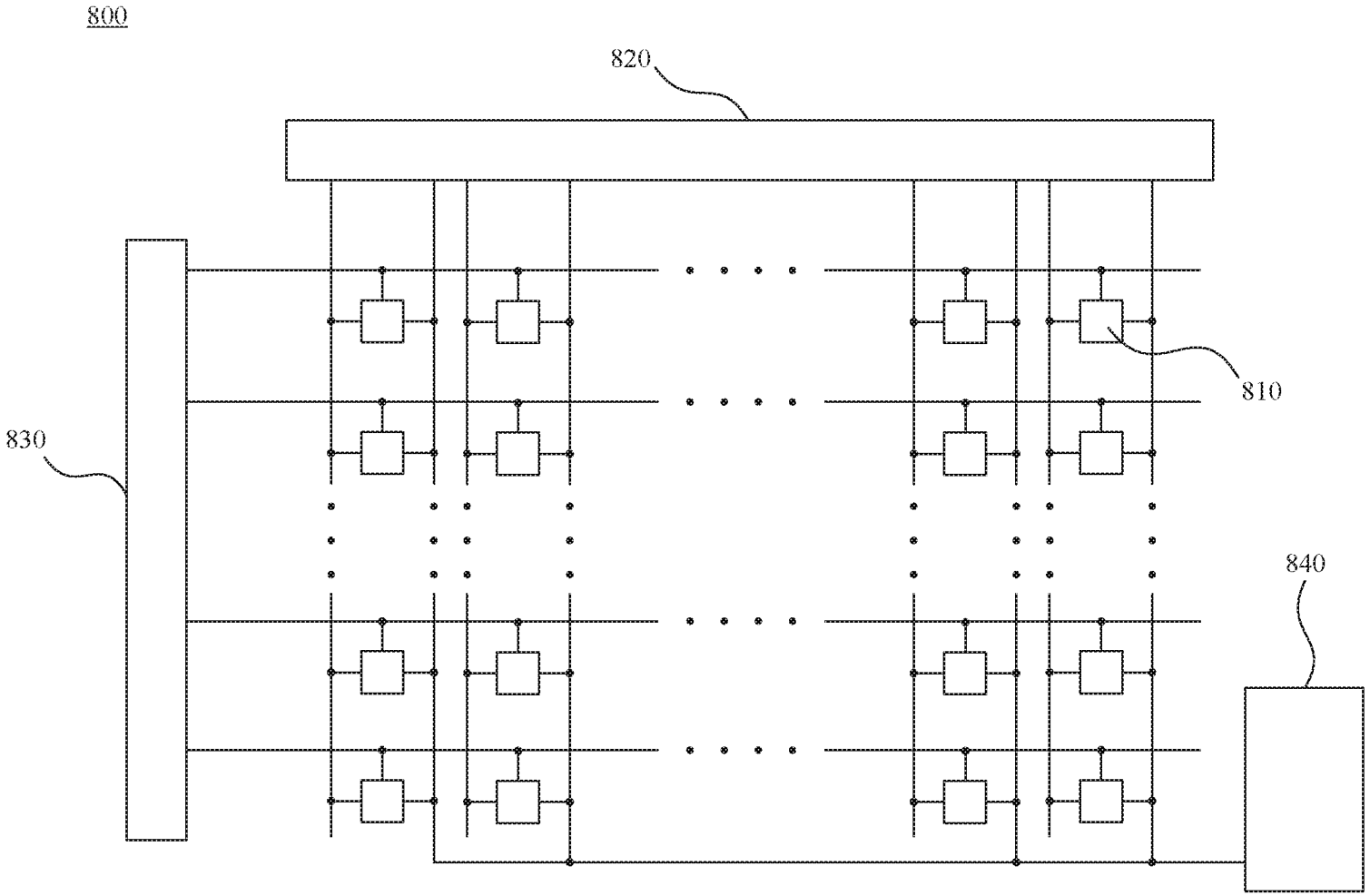
FIG. 8 is a simplified functional block diagram of a display panel according to one embodiment of the present disclosure.

FIG. 8 is a simplified functional block diagram of a display panel 800 according to one embodiment of the present disclosure. The display panel 800 comprises a plurality of pixel circuits 810, a source driver 820, a gate driver 830, and an external compensation circuit 840, and the pixel circuits 810 are arranged as a pixel array. The pixel circuit 810 may be the pixel circuit 100 of FIG. 1, the pixel circuit 200 of FIG. 2, or the pixel circuit 500 of FIG. 5; the external compensation circuit 840 may correspondingly be the external compensation circuit 101 of FIG. 1, the external compensation circuit 201 of FIG. 2, or the external compensation circuit 501 of FIG. 5. The source driver 820 is configured to provide the first data signal D1, the second data signal D2, and the linear varying voltage $V_{SW}$, but this disclosure is not limited thereto. In some embodiments, the linear varying voltage $V_{SW}$ may be provided by an additional control circuit different from the source driver 820. The gate driver 830 is configured to render the pixel circuits 810 emit synchronously. The external compensation circuit 840 is configured to detect the threshold voltage of the driving transistor of each of the pixel circuits 810, and configured to adjust the first data signal D1 provided to a corresponding pixel circuit 810 according to the threshold voltage of the driving transistor of each of the pixel circuits 810. For the sake of brevity, other functional blocks of the display panel 800 are not shown in FIG. 8.

Figure 9:
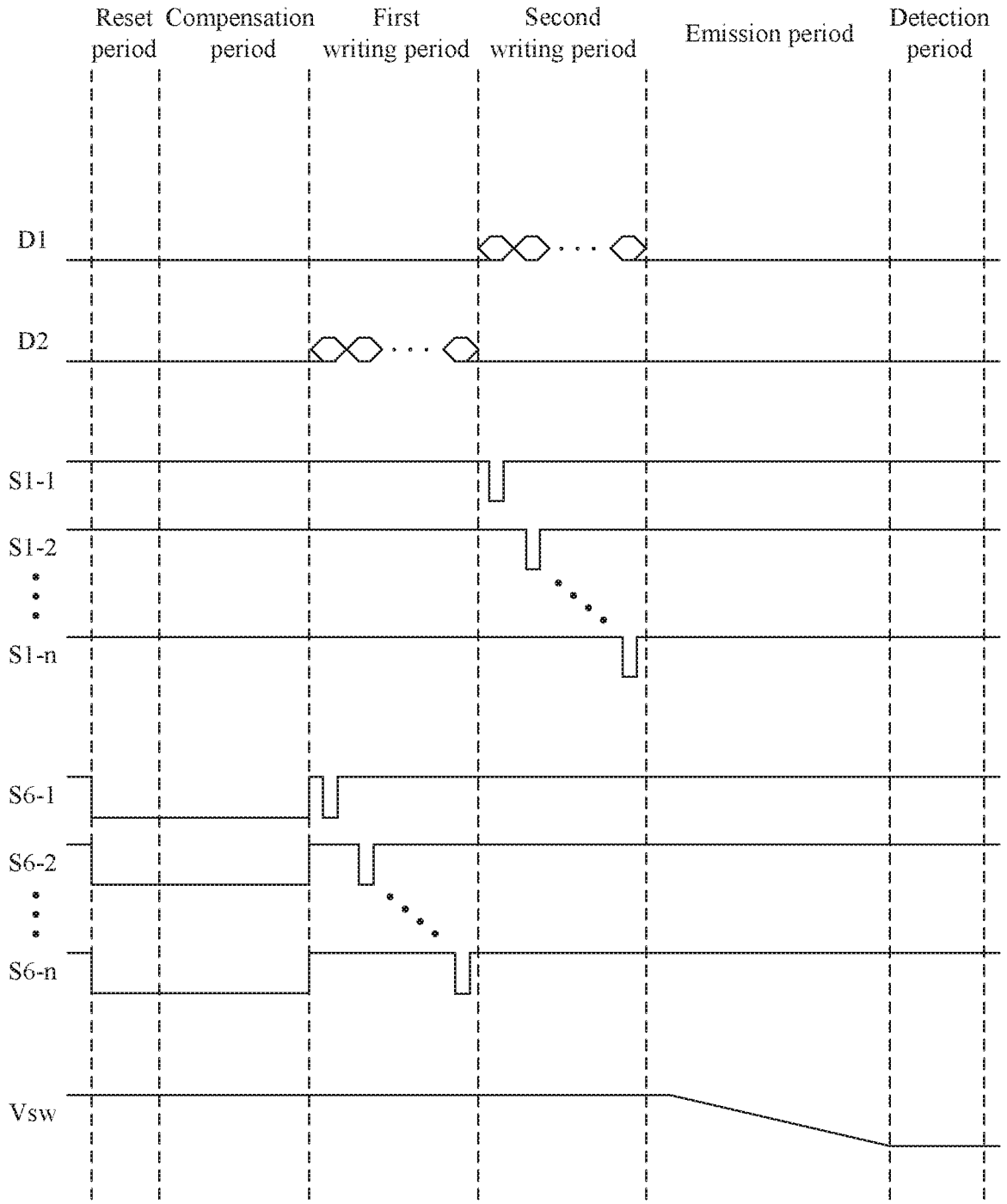
FIG. 9 is a waveform schematic diagram of the plurality of control signals of FIG. 8 according to one embodiment of the present disclosure.

In one embodiment, each of the pixel circuits 810 is realized by the pixel circuit 200 of FIG. 2. As shown in FIG. 9, in the first writing period, the gate driver 830 uses the sixth control signals S6-1~S6-*n* to conduct the seventh switches 244 in the pixel array by a row-by-row manner, so as to set the second voltage V2 of each of the pixel circuits 810. In the second writing period, the gate driver 830 use the first control signals S1-1~S1-*n* to conduct the second switches 224 in the pixel array by the row-by-row manner, so as the set the first voltage V1 of each of the pixel circuits

810. In the emission period, the source driver 820 uses the linear varying voltage $V_{SW}$ to synchronously control the second voltage V2 of each of the pixel circuits 810.

Figure 10:
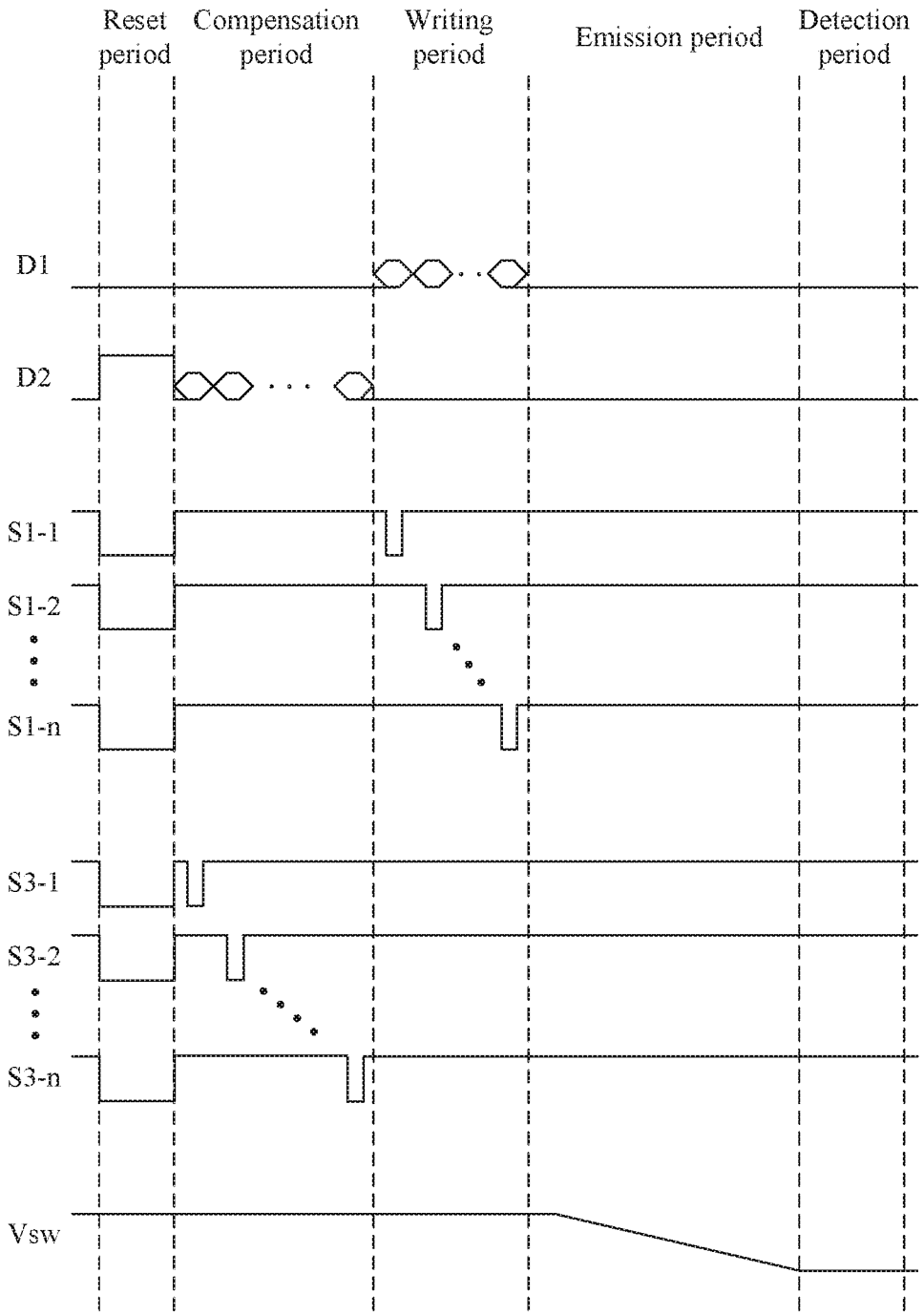
FIG. 10 is a waveform schematic diagram of the plurality of control signals of FIG. 8 according to another embodiment of the present disclosure.

In another embodiment, each of the pixel circuits 810 is realized by the pixel circuit 500 of FIG. 5. As shown in FIG. 10, in the compensation period, the gate driver 830 uses the third control signals S3-1~S3-*n* to conduct the fourth switches 534 in the pixel array by the row-by-row manner, so as to set the second voltage V2 of each of the pixel circuits 810. In the writing period, the gate driver 830 uses the first control signals S1-1~S1-*n* to conduct the second switches 524 in the pixel array by the row-by-row manner, so as to set the first voltage V1 of each of the pixel circuits 810. In the emission period, the source driver 820 uses the linear varying voltage $V_{SW}$ to synchronously control the second voltage V2 of each of the pixel circuits 810.

Throughout the specification and drawings, indexes 1~n may be used in the reference labels of signals provided to rows of the pixel array, respectively, for the ease of referring to respective signals. The use of indexes 1~n does not intend to restrict the amount of signals to any specific number. For example, the third control signal S3-1 is provided to a first row of the pixel array, and the third control signal S3-2 is provided to a second row of the pixel array, and so forth.

In the foregoing embodiments, the display panel 800 may configure the first voltage V1, according to the category of the lighting element (e.g., the emission color of the lighting element), so that the lighting element is operated at the point of maximum luminous efficiency. For example, if each of the pixel circuits 810 is realized by the pixel circuit 200 of FIG. 2, the pixel circuits 810 having the same emission color are configured to have the first voltages V1 of the same value in the second writing period. As another example, if each of the pixel circuits 810 is realized by the pixel circuit 500 of FIG. 5, the pixel circuits 810 having the same emission color are configured to have the first voltages V1 of a same value in the writing period.

In other words, the pixel circuits 810 having the same emission color would generate driving currents having the same value so as to prevent color shift. Each of the pixel circuits 810 is capable of adjusting the pulse width of the driving current, so as to provide different grayscales to the user.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The term "couple" is intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

In addition, the singular forms "a," "an," and "the" herein are intended to comprise the plural forms as well, unless the context clearly indicates otherwise.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A pixel circuit, comprising:

a lighting element, configured to emit according to a driving current;

a current source, comprising a driving transistor, and configured to provide the driving current to the lighting element by the driving transistor, wherein the driving transistor comprises a first terminal, a second terminal, and a control terminal, and the second terminal of the driving transistor is coupled with the lighting element;

an amplitude control circuit, comprising a first switch and a first node configured to provide a first voltage, wherein the amplitude control circuit is configured to provide the first voltage to the control terminal of the driving transistor by the first switch to determine magnitude of the driving current;

a pulse width control circuit, comprising a second node configured to provide a second voltage, wherein the pulse width control circuit is configured to provide the second voltage to a control terminal of the first switch to determine a pulse width of the driving current; and an internal compensation circuit, coupled with the current source and the amplitude control circuit, configured to detect a threshold voltage of the first switch, and configured to provide the driving current to an external compensation circuit to render the external compensation circuit detect a threshold voltage of the driving transistor.

2. The pixel circuit of claim 1, wherein the amplitude control circuit further comprises:

a second switch, comprising a first terminal, a second terminal, and a control terminal, wherein the first terminal of the second switch is configured to receive a first data signal, the second terminal of the second switch is coupled with the first node, and the control terminal of the second switch is configured to receive a first control signal; and a first capacitor, comprising a first terminal and a second terminal, wherein the first terminal of the first capacitor is coupled with the first node, and the second terminal of the first capacitor is configured to receive a system high voltage.

3. The pixel circuit of claim 2, wherein when the first switch and the second switch are respectively conducted and switched off, the driving transistor is operated in a saturation region and generates the driving current.

4. The pixel circuit of claim 1, wherein the internal compensation circuit comprises:

a third switch, comprising a first terminal, a second terminal, and a control terminal, wherein the first terminal of the third switch is coupled with the second terminal of the driving transistor, the second terminal of the third switch is coupled with the external compensation circuit, and the control terminal of the third switch is configured to receive a second control signal;

a fourth switch, comprising a first terminal, a second terminal, and a control terminal, wherein the first terminal of the fourth switch is coupled with second node, the second terminal of the fourth switch is coupled with the first node, and the control terminal of the fourth switch is configured to receive a third control signal; and a fifth switch, comprising a first terminal, a second terminal, and a control terminal, wherein the first terminal of the fifth switch is coupled with the control terminal of the driving transistor, the second terminal of the fifth switch is coupled with the first terminal of the driving transistor, and the control terminal of the fifth switch is configured to receive a fourth control signal.

5. The pixel circuit of claim 4, wherein when the third switch is conducted and the fourth switch and the fifth switch are switched off, the internal compensation circuit provides the driving current to the external compensation circuit and the driving current does not flow through the lighting element, wherein when the third switch is switched off and the fourth switch and the fifth switch are conducted, the internal compensation circuit provides the threshold voltage of the first switch to the second node.

6. The pixel circuit of claim 1, wherein the pulse width control circuit comprises:

a sixth switch, comprising a first terminal, a second terminal, and a control terminal, wherein the first terminal of the sixth switch is coupled with the second node, the second terminal of the sixth switch is coupled with the lighting element, the control terminal of the sixth switch is configured to receive a fifth control signal;

a seventh switch, comprising a first terminal, a second terminal, and a control terminal, wherein the first terminal of the seventh switch is configured to receive a second data signal, the second terminal of the seventh switch is coupled with a third node, and the control terminal of the seventh switch is configured to receive a sixth control signal;

a second capacitor, coupled between the second node and the third node; and a third capacitor, comprising a first terminal and a second terminal, wherein the first terminal of the third capacitor is configured to receive a linear varying voltage, and the second terminal of the third capacitor is coupled with the third node.

7. The pixel circuit of claim 6, wherein when the sixth switch and the seventh switch are switched off, the second voltage changes linearly with the linear varying voltage, wherein when the second voltage reaches a predetermined voltage, the first switch is conducted to provide the first voltage to the control terminal of the driving transistor.

8. The pixel circuit of claim 1, wherein the amplitude control circuit and the pulse width control circuit receive a first data signal and a second data signal, respectively, through a data line, wherein the amplitude control circuit generates the first voltage according to the first data signal, wherein the pulse width control circuit is further configured to receive a linear varying voltage, the pulse width control circuit determines an initial value of the second voltage according to the second data signal, and the pulse width control circuit controls the second voltage to change linearly from the initial value with the linear varying voltage, wherein when the second voltage reaches a predetermined voltage, the first switch is conducted.

9. The pixel circuit of claim 1, wherein the amplitude control circuit further comprises:

a second switch, comprising a first terminal, a second terminal, and a control terminal, wherein the first terminal of the second switch is coupled with the first node, the second terminal of the second switch is configured to receive a first data signal from a transmission line, the control terminal of the second switch is configured to receive a first control signal; and a first capacitor, comprising a first terminal and a second terminal, wherein the first terminal of the first capacitor is coupled with the first node, and the second terminal of the first capacitor is configured to receive a system high voltage, wherein when the second switch is switched off, the internal compensation circuit provides the driving current to the external compensation circuit through the transmission line.

10. The pixel circuit of claim 9, wherein the pulse width control circuit comprises a second capacitor, a first terminal of the second capacitor is configured to receive a second data signal and a linear varying voltage from a data line, and a second terminal of the second capacitor is coupled with the second node, wherein the pulse width control circuit determines an initial value of the second voltage according to the second data signal, and the pulse width control circuit controls the second voltage to change linearly from the initial value with the linear varying voltage, wherein when the second voltage reaches a predetermined voltage, the first switch is conducted.

11. A display panel, comprising:

a plurality of pixel circuits, arranged as a pixel array, wherein each of the plurality of pixel circuits comprises a first switch and a driving transistor, the first switch comprises a first terminal, a second terminal, and a control terminal, the driving transistor comprises a first terminal, a second terminal, and a control terminal, the first terminal of the first switch is coupled with the control terminal of the driving transistor, the second terminal of the first switch is coupled with a first node, and the control terminal of the first switch is coupled with a second node;

a source driver, configured to provide a first data signal, a second data signal, and a linear varying voltage to the plurality of pixel circuits;

a gate driver, configured to drive a plurality of rows of the pixel array to receive the first data signal sequentially to set a first voltage of the first node of each of the plurality of pixel circuits, and configured to drive the plurality of rows of the pixel array to receive the second data signal sequentially to set a second voltage of the second node of each of the plurality of pixel circuits, wherein the source driver uses the linear varying voltage to control the second voltage of each of the plurality of pixel circuits synchronously; and an external compensation circuit, configured to detect a threshold voltage of the driving transistor of each of the plurality of pixel circuits, and configured to adjust the first data signal provided to a corresponding pixel circuit according to the threshold voltage of the driving transistor of each of the plurality of pixel circuits;

wherein each of the plurality of pixel circuits further comprises:

a lighting element, configured to emit according to a driving current;

a current source, comprising the driving transistor, and configured to provide the driving current to the lighting element by the driving transistor, wherein the second terminal of the driving transistor is coupled with the lighting element;

an amplitude control circuit, comprising the first switch and the first node, and configured to provide the first voltage to the control terminal of the driving transistor by the first switch to determine magnitude of the driving current;

a pulse width control circuit, comprising the second node, and configured to provide the second voltage to the control terminal of the first switch to determine a pulse width of the driving current; and an internal compensation circuit, coupled with the current source and the amplitude control circuit, configured to detect a threshold voltage of the first switch, and configured to provide the driving current to the external compensation circuit to render the external compensation circuit detect the threshold voltage of the driving transistor.

12. The display panel of claim 11, wherein the amplitude control circuit further comprises:

a second switch, comprising a first terminal, a second terminal, and a control terminal, wherein the first terminal of the second switch is configured to receive the first data signal, the second terminal of the second switch is coupled with the first node, the control terminal of the second switch is configured to receive a first control signal; and a first capacitor, comprising a first terminal and a second terminal, the first terminal of the first capacitor is coupled with the first node, and the second terminal of the first capacitor is configured to receive a system high voltage.

13. The display panel of claim 12, wherein when the first switch and the second switch are respectively conducted and switched off, the driving transistor is operated in a saturation and generates the driving current, wherein pixel circuits, corresponding to a same color, of the plurality of pixel circuits generate the plurality of driving currents having same magnitude.

14. The display panel of claim 11, wherein the internal compensation circuit comprises:

a third switch, comprising a first terminal, a second terminal, and a control terminal, wherein the first terminal of the third switch is coupled with the second terminal of the driving transistor, the second terminal of the third switch is coupled with the external compensation circuit, and a the control terminal of the third switch is configured to receive a second control signal;

a fourth switch, comprising first terminal, a second terminal, and a control terminal, wherein the first terminal of the fourth switch is coupled with the second node, the second terminal of the fourth switch is coupled with the first node, and the control terminal of the fourth switch is configured to receive a third control signal; and a fifth switch, comprising a first terminal, a second terminal, and a control terminal, wherein the first terminal of the fifth switch is coupled with the control terminal of the driving transistor, the second terminal of the fifth switch is coupled with the first terminal of the driving transistor, and the control terminal of the fifth switch is configured to receive a fourth control signal.

15. The display panel of claim 14, wherein when the third switch is conducted and the fourth switch and the fifth switch are switched off, the internal compensation circuit provides the driving current to the external compensation circuit and the driving current does not flow through the lighting element, wherein when the third switch is switched off and the fourth switch and the fifth switch are conducted, the internal compensation circuit provides the threshold voltage of the first switch to the second node.

16. The display panel of claim 11, wherein the pulse width control circuit comprises:

a sixth switch, comprising a first terminal, a second terminal, and a control terminal, wherein the first terminal of the sixth switch is coupled with the second node, the second terminal of the sixth switch is coupled with the lighting element, and the control terminal of the sixth switch is configured to receive a fifth control signal;

a seventh switch, comprising a first terminal, a second terminal, and a control terminal, wherein the first terminal of the seventh switch is configured to receive the second data signal, the second terminal of the seventh switch is coupled with a third node, and the control terminal of the seventh switch is configured to receive a sixth control signal;

a second capacitor, coupled between the second node and the third node; and a third capacitor, comprising a first terminal and a second terminal, wherein the first terminal of the third capacitor is configured to receive the linear varying voltage, the second terminal of the third capacitor is coupled with the third node.

17. The display panel of claim 16, wherein when the sixth switch and the seventh switch are switched off, the second voltage changes linearly with the linear varying voltage, wherein when the second voltage reaches a predetermined voltage, the first switch is conducted to provide the first voltage to the control terminal of the driving transistor.

18. The display panel of claim 11, wherein the amplitude control circuit and the pulse width control circuit receive a first data signal and a second data signal, respectively, through a data line, wherein the amplitude control circuit generates the first voltage according to the first data signal, wherein the pulse width control circuit is further configured to receive a linear varying voltage, the pulse width control circuit determines an initial value of the second voltage according to the second data signal, and the pulse width control circuit controls the second voltage to change linearly from the initial value with the linear varying voltage, wherein when the second voltage reaches a predetermined voltage, the first switch is conducted.

19. The display panel of claim 11, wherein the amplitude control circuit further comprises:

a second switch, comprising a first terminal, a second terminal, and a control terminal, wherein the first terminal of the second switch is coupled with the first node, the second terminal of the second switch is configured to receive the first data signal from a transmission line, and the control terminal of the second switch is configured to receive a first control signal; and a first capacitor, comprising a first terminal and a second terminal, wherein the first terminal of the first capacitor is coupled with the first node, and the second terminal of the first capacitor is configured to receive a system high voltage, wherein when the second switch is switched off, the internal compensation circuit provides the driving current to the external compensation circuit through the transmission line.

20. The display panel of claim 19, wherein the pulse width control circuit comprises a second capacitor, a first terminal of the second capacitor is configured to receive the second data signal and the linear varying voltage from a data line, and a second terminal of the second capacitor is coupled with the second node, wherein the pulse width control circuit determines an initial value of the second voltage according to the second data signal, and the pulse width control circuit controls the second voltage to change linearly from the initial value with the linear varying voltage, wherein when the second voltage reaches a predetermined voltage, the first switch is conducted.

* * * * *